US006947684B2

(12) United States Patent
Fujii et al.

(10) Patent No.: US 6,947,684 B2
(45) Date of Patent: Sep. 20, 2005

(54) IMAGE FORMING APPARATUS, SHEET PROCESSING APPARATUS, AND IMAGE FORMING SYSTEM

(75) Inventors: Takayuki Fujii, Tokyo (JP); Norifumi Miyake, Chiba (JP); Tomokazu Nakamura, Chiba (JP); Kiyoshi Okamoto, Ibaraki (JP); Kiyoshi Watanabe, Chiba (JP); Hitoshi Kato, Ibaraki (JP)

(73) Assignee: Canon Kabushiki Kaisha (JP)

( * ) Notice: Subject to any disclaimer, the term of this patent is extended or adjusted under 35 U.S.C. 154(b) by 68 days.

(21) Appl. No.: 10/742,651

(22) Filed: Dec. 19, 2003

(65) Prior Publication Data

US 2004/0184823 A1 Sep. 23, 2004

(30) Foreign Application Priority Data

Dec. 26, 2002 (JP) ..... 2002-377108

(51) Int. Cl.[7] ..... G03G 15/00
(52) U.S. Cl. ..... 399/90; 399/124; 399/407
(58) Field of Search ..... 399/16, 21, 90, 399/107, 124, 407, 411

(56) References Cited

U.S. PATENT DOCUMENTS 6,647,223 B2 * 11/2003 Ishii ..... 399/90
6,647,228 B2 * 11/2003 Nakamura et al. ..... 399/124
6,807,392 B2 * 10/2004 Cho ..... 399/110

FOREIGN PATENT DOCUMENTS

JP 8-82960 A 3/1996

* cited by examiner

*Primary Examiner*—Hoang Ngo
(74) *Attorney, Agent, or Firm*—Rossi, Kimms & McDowell, LLP

(57) ABSTRACT

An image forming apparatus is provided which makes it possible to carry out maintenance on a sheet processing apparatus connected to the image forming apparatus, by opening a cover even during operation of an image forming system comprised of the image forming apparatus and the sheet processing apparatus without detaching the sheet processing apparatus from the image forming system and moving the same and initializing the system. Settings as to post-processing on sheets are made through the operation of an operation and display unit. When any of the covers is opened, a CPU determines whether image formation and sheet conveyance are to be stopped or continued according to the settings. A controller provides control according to the result of the determination.

13 Claims, 25 Drawing Sheets

FIG. 18

| | COVER 352 | COVER 353 | COVER 551 | COVER 552 | COVER 651 | COVER 652 | COVER 751 | COVER 752 | COVER 753 |
|---|---|---|---|---|---|---|---|---|---|
| ONE-SIDED PRINTING / NON-SORTING | × | ○ | × | ○ | × | ○ | × | × | ○ |
| ONE-SIDED PRINTING / SORTING | × | ○ | × | ○ | × | ○ | × | ○ | × |
| DOUBLE-SIDED PRINTING / NON-SORTING | × | × | × | ○ | × | ○ | × | × | ○ |
| DOUBLE-SIDED PRINTING / SORTING | × | × | × | ○ | × | ○ | × | ○ | × |
| ONE-SIDED PRINTING / Z-FOLDING/NON-SORTING | × | ○ | × | × | × | ○ | × | × | ○ |
| ONE-SIDED PRINTING/ Z-FOLDING / SORTING | × | ○ | × | × | × | ○ | × | ○ | × |
| DOUBLE-SIDED PRINTING / Z-FOLDING / NON-SORTING | × | × | × | × | × | ○ | × | × | ○ |
| DOUBLE-SIDED PRINTING / Z-FOLDING / SORTING | × | × | × | × | × | ○ | × | ○ | × |
| BINDING | × | × | × | ○ | × | × | ○ | ○ | ○ |

○ · · · COVER IS PERMITTED TO BE OPENED/CLOSED
× · · · COVER IS NOT PERMITTED TO BE OPENED/CLOSED

IMAGE FORMING APPARATUS, SHEET PROCESSING APPARATUS, AND IMAGE FORMING SYSTEM

BACKGROUND OF THE INVENTION

1. Field of the Invention

The present invention relates to an image forming apparatus which forms images on sheets, a sheet processing apparatus which performs various kinds of post-processing such as folding and book-binding on sheets with images formed thereon, and an image forming system including the image forming apparatus and the sheet processing apparatus.

2. Description of the Related Art

FIG. 23A is a view showing an example of a cover for a conventional image forming apparatus. In FIG. 23A, a cover 351 covers all of the following: a conveying path via which an image is formed on a sheet fed from any of cassettes provided in the apparatus, a conveying path via which a sheet with an image formed thereon is discharged from the apparatus, and a conveying path via which a sheet with an image formed on one side thereof is inverted and conveyed to an image forming unit in a double-sided recording mode. Therefore, when the cover 351 is opened, it is possible to access all the conveying paths.

The above described cover provided in the image forming apparatus is not opened during normal image formation, but is opened while image formation is not carried out, e.g. during a jam removal process or maintenance. Thus, when the cover is opened during image formation, it is judged that an abnormal state has occurred, and then all the operations being performed are stopped, which is unproductive.

To address this problem, Japanese Laid-Open Patent Publication (Kokai) No. H08-082960 has proposed an image forming apparatus which is provided with an open/close cover for removing recording sheets remaining in a double-sided recording unit as shown in FIG. 23B, so that one-sided recording can be performed even if the open/close cover is opened insofar as a double-sided recording mode is not set.

In a conventional image forming system including the image forming apparatus as described above, one-sided recording can be performed without stopping the operation of the entire system when the jam removal process is carried out in the double-sided recording unit, but when the cover is opened/closed for maintenance of a sheet processing apparatus (such as a folding unit, a book-binding unit, or a finisher), the operation of the entire system has to be stopped, which is unproductive.

Further, post-processes such as a bundle-discharging process, stapling process, folding process, and book-binding process desired by the user can be realized in one image forming system by connecting a plurality of sheet processing apparatuses intended exclusively for the respective post-processes to the image forming apparatus, but to carry out maintenance on the sheet processing apparatuses without stopping the operation of the entire system, the sheet processing apparatuses to be subjected to maintenance has to be detached from the system to which the plurality of sheet processing apparatuses are connected, and then moved. On this occasion, the image forming system must be initialized again so as to recognize a sheet processing apparatus to which is connected a controller which controls the overall operation of the system.

Further, it is necessary to regularly carry out maintenance on the sheet processing apparatus by e.g. replacement of parts, adjustments, and cleaning after a predetermined number of sheets are passed through the sheet processing apparatus, but all the sheets are not necessarily passed through the same conveying path. In a stapling mode, folding mode, book-binding mode, etc. of the sheet processing unit, the number of sheets passed through conveying paths varies according to settings made by the user, and the timing for maintenance is different depending on the sheet processing apparatuses and the conveying paths in the image forming system. For example, in the case of replacement of parts for maintenance, the number of sheets which can be endured by parts differs even if the number of sheets passed through the parts is the same, and hence the timing for maintenance is different depending on the sheet processing apparatuses and the conveying paths in the system.

SUMMARY OF THE INVENTION

It is therefore an object of the present invention to provide an image forming apparatus, a sheet processing apparatus, and an image forming system, which make it possible to carry out maintenance on the sheet processing apparatus, by opening a cover even during operation of the system without detaching the sheet processing apparatus from the image forming system and moving the same and initializing the system.

To attain the above object, in a first aspect of the present invention, there is provided an image forming apparatus connected to a sheet processing apparatus having a plurality of covers capable of being opened and closed, comprising an operating section that makes settings as to post-processing to be performed on sheets by the sheet processing apparatus, a determining section responsive to opening of any of the plurality of covers, for making a determination as to whether image formation and sheet conveyance are to be stopped or continued, according to the settings made by the operating section, and a controller that provides control according to a result of the determination made by the determining section.

Preferably, the image forming apparatus comprises a storage that stores information indicative of whether image formation and sheet conveyance are to be stopped or continued when each of the plurality of covers is opened according to patterns of the settings as to post-processing, and the determining section makes the determination according to the information stored in the storage.

Preferably, the image forming apparatus comprises light emitters operable in accordance with the settings made by the operating section, for emitting light to indicate which covers do not cause image formation and sheet conveyance to be stopped even when opened among the plurality of covers.

More preferably, the light emitters are provided in association with respective ones of the plurality of covers.

Preferably, the image forming apparatus comprises a display that displays information indicative of the settings made by the operating section, and the display displays information indicative of which covers do not cause image formation and sheet conveyance to be stopped when opened among the plurality of covers according to the settings made by the operating section.

Preferably, the determining section is operable in accordance with the settings made by the operating section, for determining that image formation and sheet conveyance are to be continued even when all the covers provided in the sheet processing apparatus are opened while the sheet processing apparatus is not to be used.

To attain the above object, in a second aspect of the present invention, there is provided an image forming apparatus connected to a sheet processing apparatus having a plurality of covers capable of being opened and closed, comprising a locking section that locks each of the plurality of covers to inhibit the cover from being opened, an operating section that makes settings as to post-processing to be performed on a sheet on which an image has been formed by the image forming apparatus, a determining section that makes a determination as to whether each of the plurality of covers is to be locked by the locking section, according to the settings made by the operating section, and a controller that provides control according to a result of the determination made by the determining section.

To attain the above object, in a third aspect of the present invention, there is provided a sheet processing apparatus connected to an image forming apparatus which forms an image on a sheet, for performing post-processing on a sheet on which an image has been formed by the image forming apparatus, conveyed to the sheet processing apparatus, comprising a plurality of covers capable of being opened and closed, a determining section responsive to opening of any of the plurality of covers, for making a determination as to whether image formation and sheet conveyance are to be stopped or continued, according to settings as to post-processing, and a controller that provides control according to a result of the determination made by the determining section.

To attain the above object, in a fourth aspect of the present invention, there is provided a sheet processing apparatus connected to an image forming apparatus which forms an image on a sheet, for performing post-processing on a sheet on which an image has been formed by the image forming apparatus, conveyed to the sheet processing apparatus, comprising a plurality of covers capable of being opened and closed, a locking section that locks each of the plurality of covers to inhibit the cover from being opened, a determining section that makes a determination as to whether each of the plurality of covers is to be locked by the locking section, according to settings as to post-processing, and a controller that provides control according to a result of the determination made by the determining section.

To attain the above object, in a fifth aspect of the present invention, there is provided an image forming system including an image forming apparatus which forms an image on a sheet, and a sheet processing apparatus which performs post-processing on a sheet on which an image has been formed by the image forming apparatus, conveyed to the sheet processing apparatus, the sheet processing apparatus having a plurality of covers capable of being opened and closed, comprising an operating section that makes settings as to post-processing to be performed on a sheet on which an image has been formed by the image forming apparatus, a determining section responsive to opening of any of the plurality of covers, for making a determination as to whether image formation and sheet conveyance are to be stopped or continued, according to the settings made by the operating section, and a controller that provides control according to a result of the determination made by the determining section.

Preferably, the image forming system comprises a common conveying path through which all of sheets conveyed from the image forming apparatus to the sheet processing apparatus pass, and a function module section that performs post-processing on a sheet, and the determining section determines that image formation and sheet conveyance are to be stopped when one of the plurality of covers for covering the common conveying path or the function module section is opened while the common conveying path or the function module section is to be used, and determines that image formation and sheet conveyance are to be continued when the cover for covering the common conveying path or the function module section is opened while the common conveying path or the function module section is not to be used.

More preferably, the function module section is capable of being taken out from the sheet processing apparatus in a state in which the cover for covering the function module part is opened.

To attain the above object, in a sixth aspect of the present invention, there is provided an image forming system including an image forming apparatus which forms an image on a sheet, and a sheet processing apparatus which performs post-processing on a sheet on which an image has been formed by the image forming apparatus, conveyed to the sheet processing apparatus, the sheet processing apparatus having a plurality of covers capable of being opened and closed, comprising a locking section that locks each of the plurality of covers to inhibit the cover from being opened, an operating section that makes settings as to post-processing to be performed on a sheet on which an image has been formed by the image forming apparatus, a determining section that makes a determination as to whether each of the plurality of covers is to be locked by the locking section, according to the settings made by the operating section, and a controller that provides control according to a result of the determination made by the determining section.

The above and other objects, features, and advantages of the invention will become more apparent from the following detailed description taken in conjunction with the accompanying drawings.

BRIEF DESCRIPTION OF THE DRAWINGS

FIG. 18 is a view showing a table that indicates which covers are permitted to be opened/closed according to various settings;

FIGS. 23A and 23B are views showing conventional image forming apparatuses, in which FIG. 23A shows an image forming apparatus in which one cover is provided, and FIG. 23B shows an image forming apparatus in which a plurality of covers are provided.

DETAILED DESCRIPTION OF THE PREFERRED EMBODIMENTS

The present invention will now be described in detail with reference to the drawings showing preferred embodiments thereof.

Figure 1:
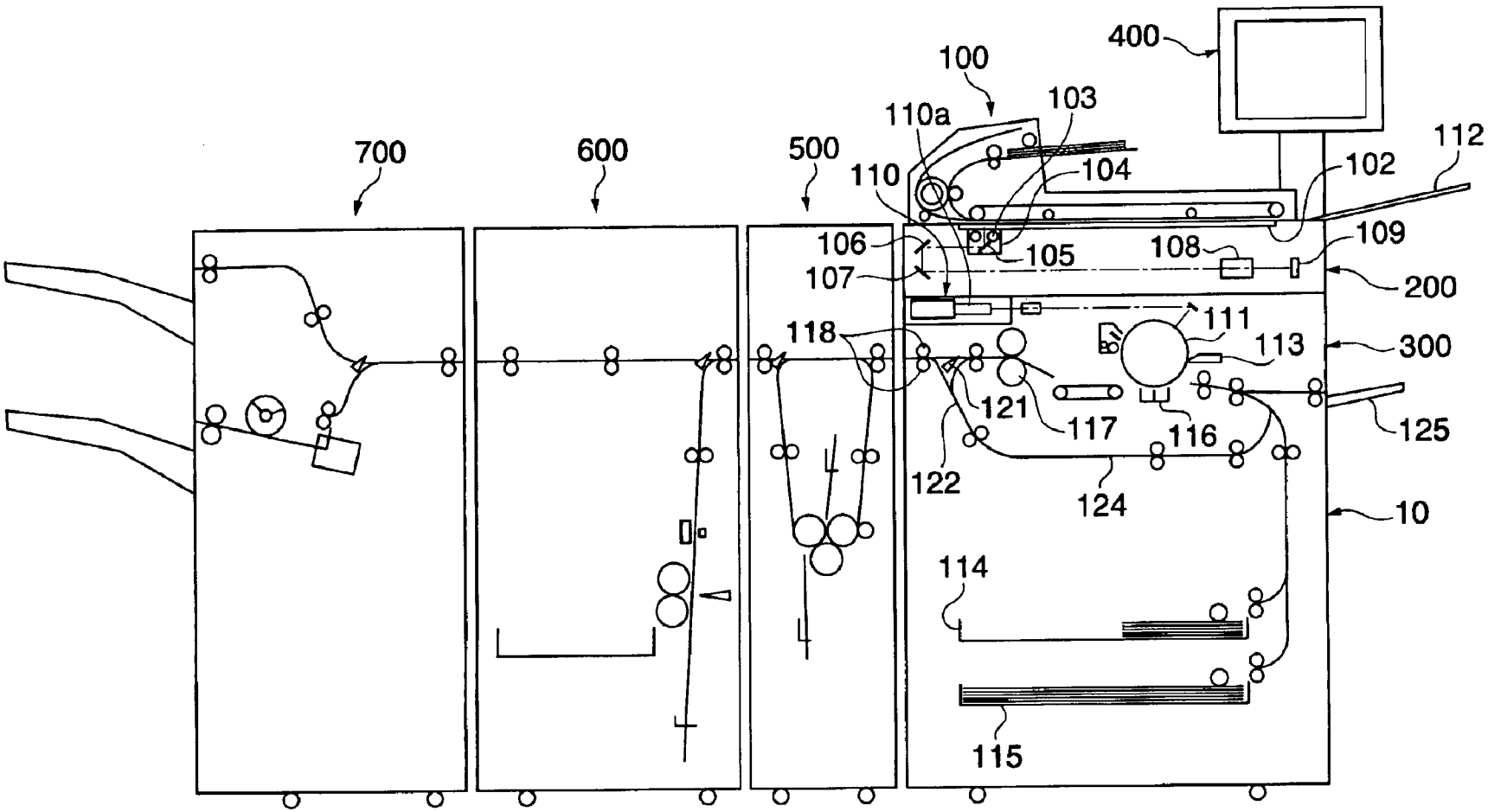
FIG. 1 is a longitudinal sectional view showing the entire construction of essential parts of an image forming system according to a first embodiment of the present invention.

FIG. 1 is a longitudinal sectional view showing the construction of essential parts of an image forming apparatus according to a first embodiment of the present invention.

As shown in FIG. 1, the image forming apparatus is comprised of an image forming apparatus main body 10, a folding unit 500, a book-binding unit 600, and a finisher 700. The image forming apparatus main body 10 is provided therein with an image reader 200 for reading images on originals, and a printer 300.

An original feeder 100 is mounted on the image reader 200. The original feeder 100 feeds originals one by one to the left as viewed in FIG. 1, starting with the top page of the originals set with upper surfaces thereof facing upward on an original tray, such that the originals are guided along a curved path to be conveyed from the left onto a platen glass 102 and then through a moving original reading position to the right, and subsequently discharged onto an external discharged sheet tray 112. When the original passes the moving original reading position on the platen glass 102 from the left to the right, an image on the original is read by a scanner unit 104 held at a location corresponding to the moving original reading position. This reading method is a so-called "moving original reading method". More specifically, when the original passes the moving original reading position, an image-formed surface of the original is illuminated by a lamp 103 of the scanner unit 104, and light reflected from the original is led to a lens 108 via mirrors 105, 106, and 107. The light having passed the lens 108 is focused on an image forming plane of an image sensor 109 to form an image thereon.

By conveying an original such that the original passes the moving original reading position from the left to the right, scanning is performed to read the original in the main scanning direction perpendicular to the direction in which the original is conveyed, and in the sub-scanning direction identical with the direction in which the original is conveyed. More specifically, as the original passes the moving original reading position, an image on the original is read out line by line in the main scanning direction by the image sensor 109, while the original is conveyed in the sub-scanning direction, so that the whole image on the original is read. The optically read image is converted into image data by the image sensor 109 and then output. The image data output from the image sensor 109 is subjected to predetermined processing by an image signal controller 202, described later, and then input as a video signal to an exposure controller 110 of the printer 300.

It should be noted that after an original is conveyed onto the platen glass 102 by the original feeder 100, the original may be stopped at a predetermined position where the image on the original is read out by causing the scanner unit 104 to scan the original from the left to the right. This reading method is a so-called stationary original reading method.

To read an image on an original without using the original feeder 100, first, the user lifts the original feeder 100 to place the original on the platen glass 102, and the scanner unit 104 then scans the original from the left to the right to read the image thereon. Namely, to read an image on an original without using the original feeder 100, the stationary original reading is carried out.

The exposure controller 110 of the printer 300 modulates laser light according to the input video signal and outputs the same. The laser light is irradiated upon a photosensitive drum 111 while being scanned by a polygon mirror 110*a*. An electrostatic latent image corresponding to the scanned laser light is formed on the photosensitive drum 111. As described later, when the stationary original reading is carried out, the exposure controller 110 outputs the laser light to form a normal image (not a mirror image).

The electrostatic latent image formed on the photosensitive drum 111 is visualized as a toner image by a developer supplied from a developing unit 113. In timing synchronous with the start of laser light irradiation, a sheet is fed from a cassette 114 or 115, a manual feed section 125, or a double-sided conveying path 124, and is conveyed to a space between the photosensitive drum 111 and a transfer unit 116. The toner image formed on the photosensitive drum 111 is transferred onto the fed sheet by the transfer unit 116.

The sheet onto which the toner image has been transferred is conveyed to a fixing unit 117, and the fixing unit 117 fixes the toner image on the sheet with heat and pressure. After passing through the fixing unit 117, the sheet is discharged from the printer 300 to an external device (folding unit 500) via a flapper 121 and a pair of discharging roller 118.

Where the sheet is discharged with a surface on which the image is formed facing downward, the sheet having passed through the fixing unit 117 is guided into an inversion path 122 by a switching action of the flapper 121, and after the trailing end of the sheet passes through the flapper 121, the sheet is switched back and discharged from the printer 300 by the discharging rollers 118. This type of sheet discharging will hereinafter be referred to as "sheet inverted discharging". The sheet inverted discharging is carried out when image formation is successively performed sheet by sheet starting with the top page, e.g. when the original feeder 100 is used to read images to be formed or when images output from a computer are formed. The sheets discharged by the sheet inverted discharging are stacked in a proper page order.

When hard sheets such as OHP sheets are fed from the manual feed section 125 to have images formed thereon, the sheets are not led to the inversion path 122, but are discharged by the discharging rollers 118 with surfaces thereof on which images are formed facing upward.

In a double-sided recording mode in which images are formed on both sides of a sheet, a sheet is guided to the inversion path 122 by the switching action of the flapper 121 and then conveyed to the double-sided recording path 124. The sheet guided to the double-sided conveying path is fed again to the space between the photosensitive drum 111 and the transfer unit 116 in the above described timing.

The sheet discharged from the printer 300 is fed to the folding unit 500. The folding unit 500 is used for folding a sheet in the form of Z. For example, in the case where A3-size or B4-size sheets are used and the execution of a folding process is designated, the folding unit 500 carries out the folding process, and otherwise, the sheets discharged from the printer 300 are conveyed to the book-binding unit 600 via the folding unit 500 and fed to the finisher 700.

The book-binding unit 600 carries out a book-binding process in which sheets are folded in half and bound together. The finisher 700 carries out various processes such as a stapling process.

Figure 2:
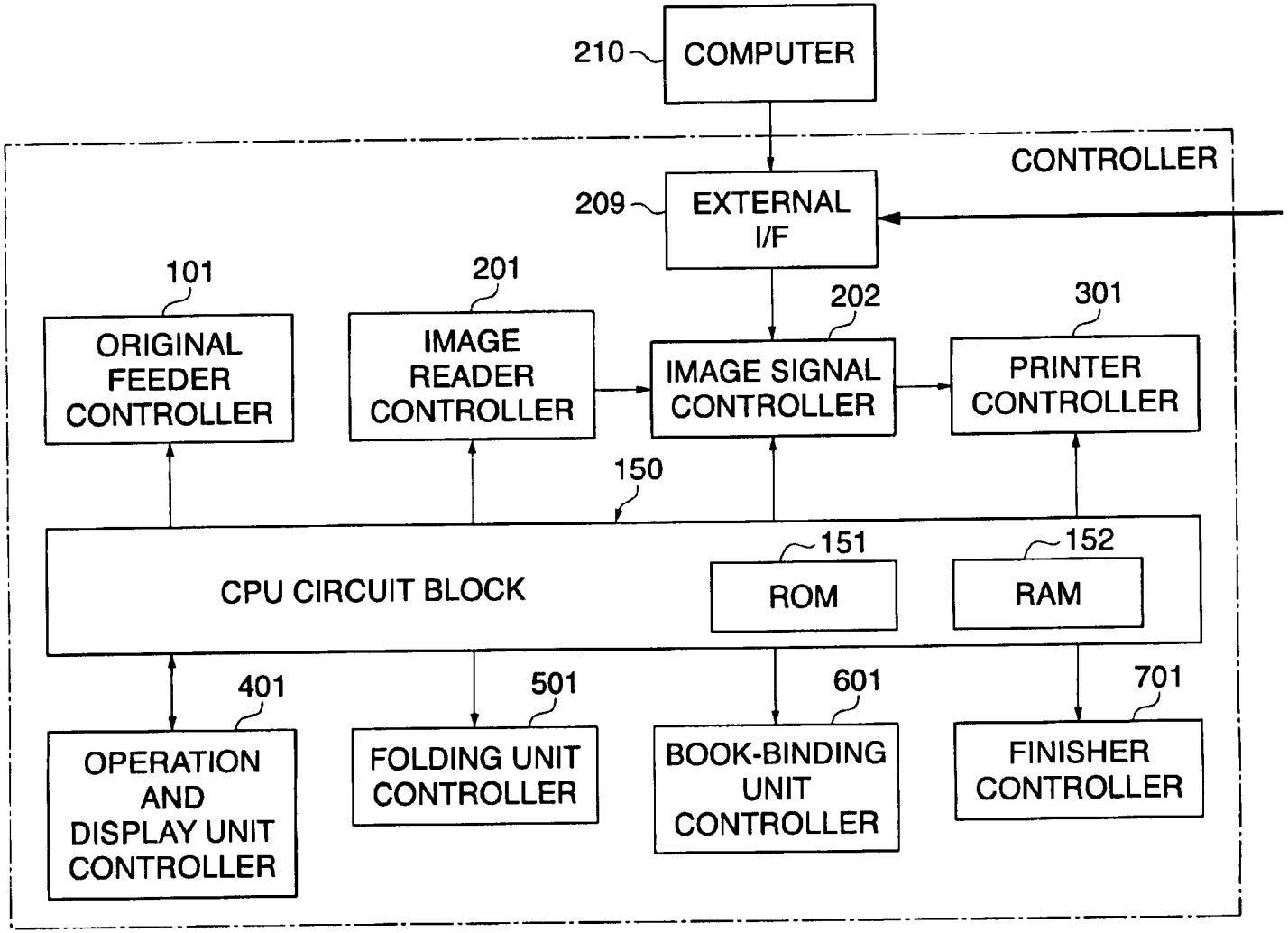
FIG. 2 is a block diagram showing the configuration of a controller which controls the overall operation of an image forming apparatus appearing in FIG. 1.

Referring next to FIG. 2, a description will now be given of the configuration of a controller which controls the overall operation of the image forming apparatus according to the present embodiment. FIG. 2 is a block diagram showing the configuration of the controller which controls the overall operation of the image forming apparatus appearing in FIG. 1.

As shown in FIG. 2, the controller is comprised of a CPU circuit block 150, an original feeder controller 101, an image reader controller 201, an image signal controller 202, an external interface (I/F) 209, a printer controller 301, an operation and display unit controller 401, a folding unit controller 501, a book-binding unit controller 601, and a finisher controller 701. The CPU circuit block 15O has a CPU, not shown, a ROM 151, and a RAM 152 incorporated therein, and collectively controls the controllers 101, 201, 202, 301, 401, 501, 601, and 701, and the external I/F 209 according to control programs stored in the ROM 151. The RAM 152 is used for temporarily storing control data and serves as a work area for operations performed for control.

The original feeder controller 101 controls the operation of the original feeder 100 according to an instruction given from the CPU circuit block 150. The image reader controller 201 controls the operation of the above mentioned scanner unit 104, image sensor 109, and so forth, and transfers an analog image signal output from the image sensor 109 to the image signal controller 202.

The image signal controller 202 converts the analog image signal received from the image sensor 109 into a digital signal, performs various kinds of processing on the digital signal, and converts the resulting digital signal into a video signal and outputs the video signal to the printer controller 301. The image signal controller 202 also performs various kinds of processing on a digital image signal input from a computer 210 via the external I/F 209, and converts the digital image signal into a video signal and outputs the video signal to the printer controller 301. The operation of the image signal controller 202 is controlled by the CPU circuit block 150. The printer controller 301 controls the operation of the above-mentioned exposure controller 110 according to the input video signal.

The operation and display unit controller 401 provides control to exchange information between an operation and display unit 400 and the CPU circuit block 150. The operation and display unit 400 includes a plurality of keys for setting various functions relating to image formation, a display for displaying information indicative of settings, and so forth. The operation and display unit 400 outputs a key signal corresponding to the operation of each key to the CPU circuit block 150, and displays on the display section of the controller 401 information corresponding to a signal from the CPU circuit block 150.

The folding unit controller 501 is provided in the folding unit 500, and controls the operation of the entire folding unit 500 by transmitting and receiving information to and from the CPU circuit block 150.

The book-binding unit controller 601 is provided in the book-binding unit 600, and controls the operation of the entire book-binding unit 600 by transmitting and receiving information to and from the CPU circuit block 150.

The finisher controller 701 is provided in the finisher 700, and controls the operation of the entire finisher 700 by transmitting and receiving information to and from the CPU circuit block 150 as described later in further detail.

Figure 3:
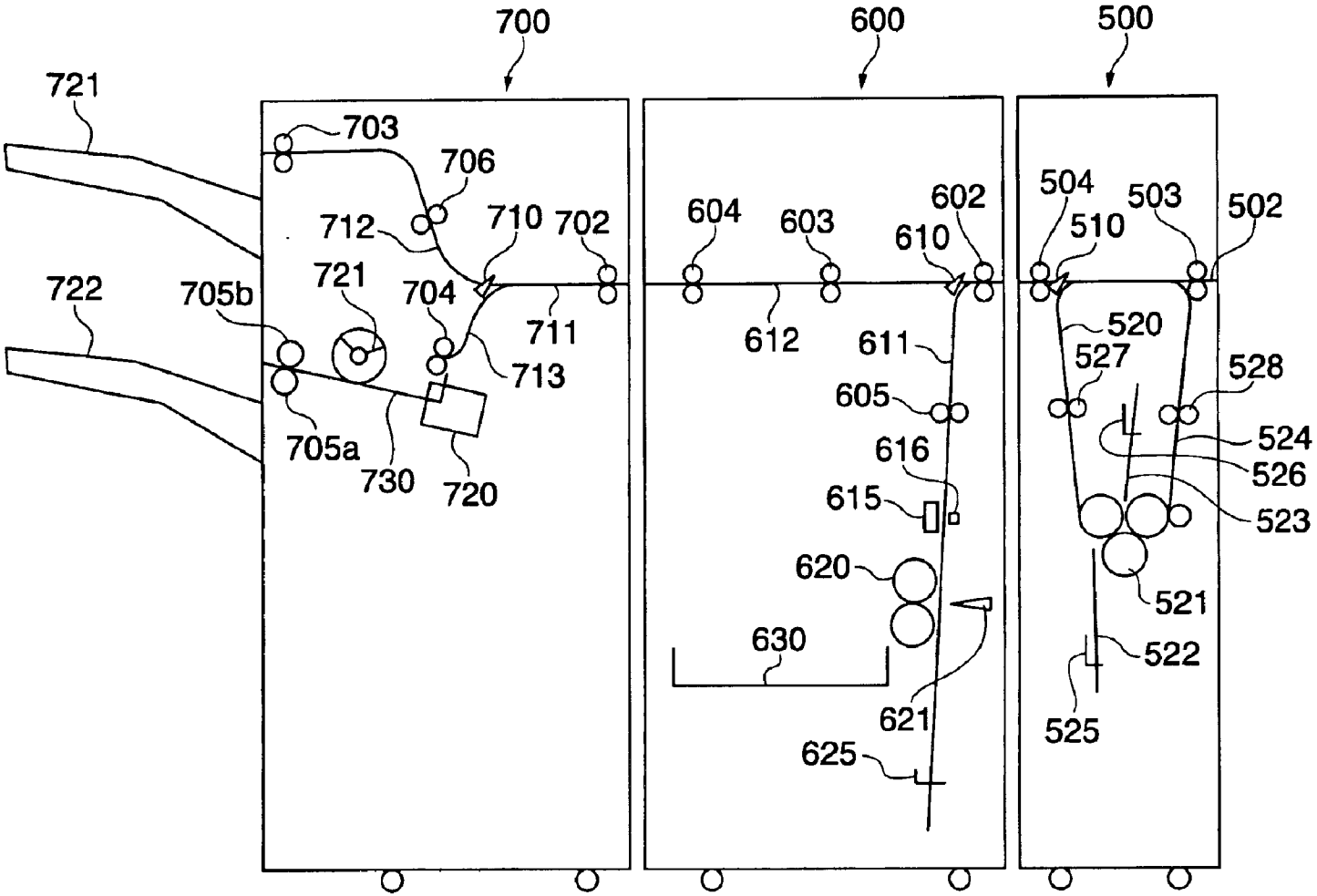
FIG. 3 is a sectional view showing the constructions of sheet processing apparatuses appearing in FIG. 1.

A description will now be given of the constructions of the folding unit 500, book-binding unit 600, and finisher 700 with reference to FIG. 3. FIG. 3 is a view showing the constructions of the folding unit 500, book-binding unit 600, and finisher 700 appearing in FIG. 1.

As shown in FIG. 3, the folding unit 500 has a folding horizontal conveying path 502 for taking in a sheet discharged from the printer 300 and guiding the sheet toward the book-binding unit 600. A pair of conveying rollers 503 and a pair of conveying rollers 504 are provided on the folding horizontal conveying path 502. Further, a folding path selecting flapper 510 is provided at an exit of the folding horizontal conveying path 502 (on the side of the book-binding unit 600). The folding path selecting flapper 510 performs a switching action for selectively guiding a sheet on the folding horizontal conveying path 502 to the folding path 520 or toward the book-binding unit 500.

In the case where the folding process is carried out, the folding path selecting flapper 510 is switched on to guide the sheet to the folding path 520. The sheet guided to the folding path 520 is guided to a folding path 522, and conveyed until the leading end thereof comes into contact with a first holding stopper 525. The sheet is then guided to a folding path 523 by a folding roller 521, and at the same time is folded at ¼ from the leading end thereof and conveyed by the folding roller 521 until the leading end thereof reaches a second folding stopper 526. The sheet is further guided to a folding path 524 by the folding roller 521, and at the same time is folded at the center thereof into the form of Z by the folding roller 521. On the other hand, in the case where the folding process is not carried out, the folding path selecting flapper 510 is switched off, so that the sheet is directly conveyed from the printer 300 to the book-binding unit 600 via the folding horizontal conveying path 502.

The book-binding unit 600 has a book-binding horizontal conveying path 612 for taking in a sheet discharged via the folding unit 500 and guiding the sheet toward the finisher 700. Pairs of conveying rollers 602, 603, and 604 are provided on the book-binding horizontal conveying path 612. Further, a book-binding path selecting flapper 610 is provided at an entrance of the book-binding horizontal conveying path 612 (on the side of the folding unit 500). The book-binding path selecting flapper 610 performs a switching action for selectively guiding a sheet on the book-binding horizontal conveying path 612 to a book-binding path 611 or toward the finisher 700.

In the case where the book-binding process is carried out, the book-binding path selecting flapper 610 is switched on to guide the sheet to the book-binding path 611. The sheet guided to the book-binding path 611 is conveyed by a pair of conveying rollers 605 until the leading end of the sheet comes into contact with a movable sheet positioning member 625. Two pairs of staplers 615 are provided in the middle of the book-binding path 611, and are configured to cooperate with an anvil 616 disposed opposite thereto to staple a bundle of sheets at the center thereof.

A pair of folding rollers 620 are provided downstream of the staplers 615. A thrusting member 621 is provided opposite to the folding rollers 620. By thrusting out the thrusting member 621 against a bundle of sheets stored in the book-binding path 611, the bundle of sheets is pushed into a space between the folding rollers 620. The bundle of sheets is then folded by the folding rollers 620 and discharged onto a book-binding discharge tray 630.

To fold a bundle of sheets stapled by the staplers 615, the positioning member 625 is lowered by a predetermined distance to bring a staple position of the bundle of sheets to the center of the folding rollers 620.

On the other hand, in the case where the book-binding process is not carried out, the book-binding path selecting flapper 610 is switched off, so that the sheet is conveyed from the folding unit 600 to the finisher 700 via the book-binding horizontal conveying path 612.

The finisher 700 carries out various post-processes such as a process in which sheets discharged from the printer 300 via the folding unit 500 and the book-binding unit 600 are taken into the finisher 700 and then aligned into a bundle, a stapling process in which a bundle of sheets is stapled at a rear edge thereof, a sort process, and a non-sort process.

As shown in FIG. 3, the finisher 700 has a pair of inlet rollers 702 for guiding a sheet discharged from the printer 300 via the folding unit 500 and the book-binding unit 600 to the finisher 700. The sheet conveyed by the inlet rollers 702 is guided to a finisher path 711. A switching flapper 710 is disposed downstream of the finisher path 711. The switching flapper 710 is for guiding a sheet to a non-sort path 712 or a sort path 713.

In the case where the non-sort process is carried out, the switching flapper 710 is switched on to guide sheets to the non-sort path 712. The sheets are discharged onto a sample tray 721 via a pair of conveying rollers 706 and a pair of non-sort discharging rollers 703 provided on the non-sort path 712.

On the other hand, in the case where the stapling process or the sort process is carried out, the switching flapper 710 is switched off to guide sheets to the sort path 713. The sheets guided to the sort path 713 are stacked on an intermediate tray 730 via a pair of sort discharging rollers 704.

The sheets stacked in a bundle on the intermediate tray 730 are subjected to aligning, stapling, or the like as the need arises, and then discharged onto a stack tray 722 by discharging rollers 705*a* and 705*b*. A stapler 720 is used for stapling a bundle of sheets stacked on the intermediate tray 730. The operation of the stapler 720 will be described later. The stack tray 722 is capable of freely moving up and down.

Figure 4:
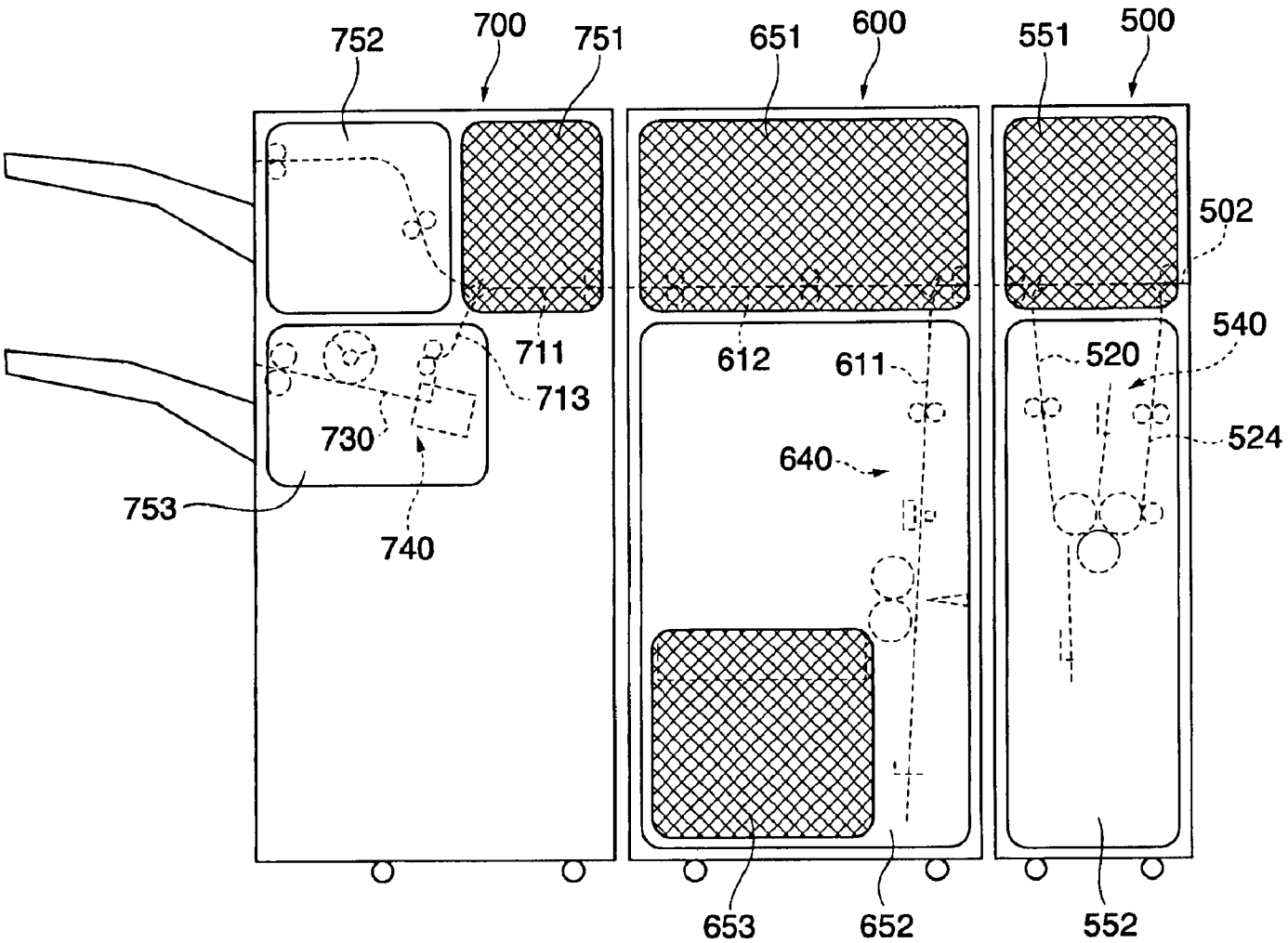
FIG. 4 is a view showing a plurality of covers for the sheet processing apparatuses.

FIG. 4 is a view showing covers for the folding unit 500, book-binding unit 600, and finisher 700.

The folding unit 500 is provided with a cover 551 for covering a folding horizontal path section including the folding horizontal conveying path 502, and a cover 552 for covering a folding processing section 540 including the folding paths 520 and 524. The covers 551 and 552 can be opened and closed independently of each other.

The book-binding unit 600 is provided with a cover 651 for covering a binding horizontal path section including the book-binding horizontal conveying path 612, and a cover 652 for covering a book-binding processing section 640 including the book-binding path 611. The covers 651 and 652 can be opened and closed independently of each other.

The finisher 700 is provided with a cover 751 for covering a finisher path section including the finisher path 711, a cover 752 for covering a non-sort path section including the non-sort path 712, and a cover 753 for covering a sort processing section 740 including the sort path 713 and the intermediate tray 730. The covers 751, 752, and 753 can be opened and closed independently of each other.

The above described covers 551, 552, 651, 652, 751, 752, and 753 are opened and closed to carry out a jam removal process or maintenance such as replacement of parts, cleaning, or adjustment.

Figure 5A:
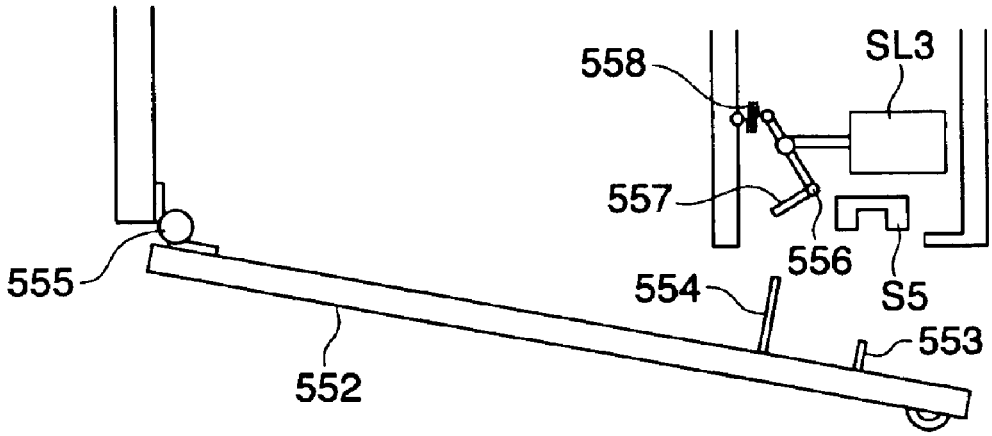
FIGS. 5A and 5B are views useful in explaining a cover locking mechanism.
Figure 5B:
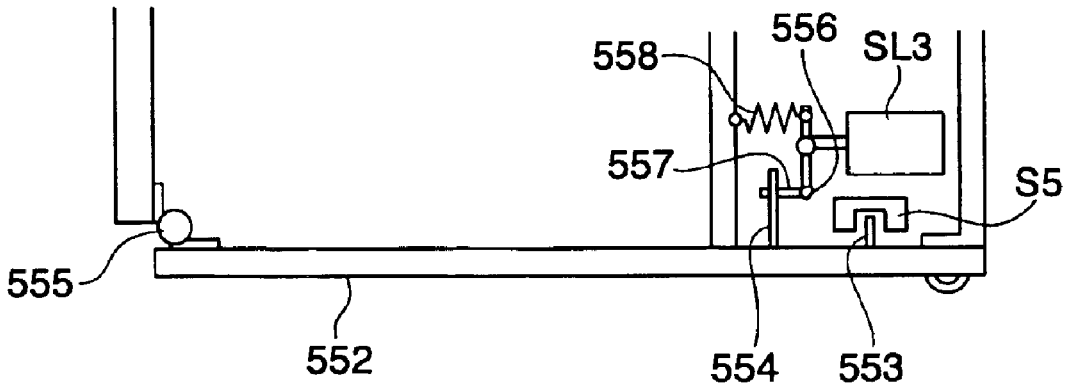

Each of the covers 551, 552, 651, 652, 751, 752, and 753 for the folding unit 500, book-binding unit 600, and finisher 700 is provided with an open/close detecting mechanism and a door locking mechanism, as shown in FIGS. 5A and 5B. In the following description, the cover 552 for the folding processing section 540 of the folding unit 500 will be taken as an example.

FIG. 5A shows a door unlocked state, and FIG. 5B shows a door locked state.

The cover 552 is rotatably supported by e.g. a column of the folding unit 550 via a hinge 555. The cover 552 is provided with an open/close detecting sensor flag 553. When the cover 552 is closed, a cover open/close detecting sensor S5 detects that light is shielded by the open/close sensor flag 553. In this way, the opening/closing of the cover 552 can be detected.

A description will now be given of the locking mechanism. A hook 557 is connected to an end of a cover lock solenoid SL3 implemented by an electromagnetic solenoid. The hook 557 is held such that it may rotate about a shaft 556 fixed to the folding unit 500. The hook 557 is constantly pulled by a tension spring 558 in such a direction as to move away from a plate 554 that is provided on the cover 552 and has a keyhole in which the hook 557 is to be hooked. When the cover lock solenoid SL3 is actuated, the hook 557 rotates in such a direction as to be inserted into the keyhole of the plate 554. On this occasion, if the cover 552 is closed, the hook 557 is hooked in the keyhole of the plate 554 to lock the cover 552, so that the cover 552 is inhibited from being opened. When the cover lock solenoid SL3 is switched off, the tension spring 558 causes the hook 557 to be released from the keyhole of the plate 554, so that the cover 552 is unlocked.

Figure 6:
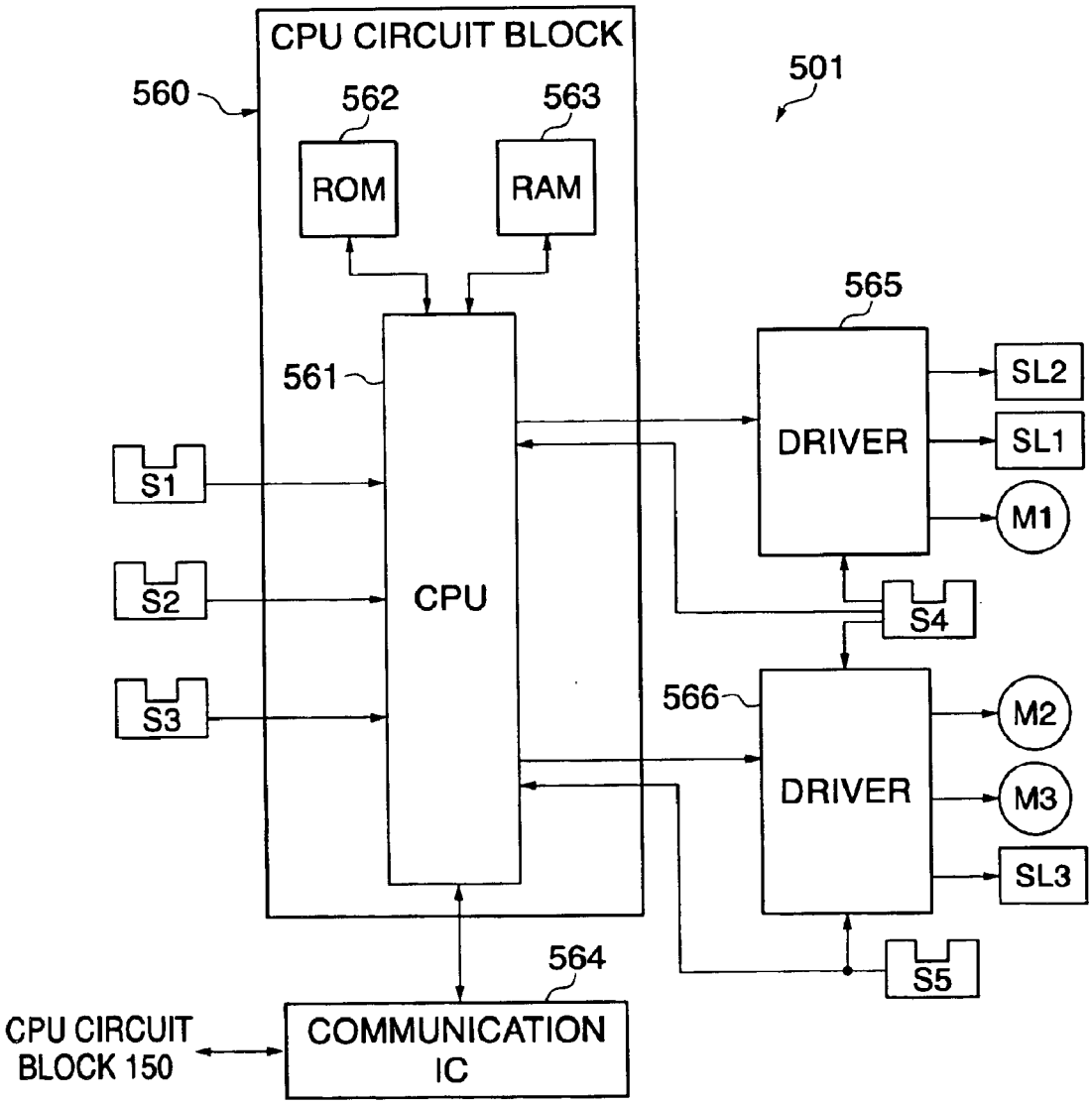
FIG. 6 is a block diagram showing the construction of a folding unit controller.

Referring next to FIG. 6, a description will be given of the construction of the holding device controller 501 which controls the operation of the folding unit 500. FIG. 6 is a block diagram showing the construction of the folding unit controller 501 appearing in FIG. 2.

As shown in FIG. 6, the folding unit controller 501 includes a CPU circuit block 560 comprised of a CPU 561, a ROM 562, a RAM 563, and so forth. The CPU circuit block 560 communicates and exchanges data with the CPU circuit block 150, which is provided in the main body 10 of the image forming apparatus, via a communication IC 564, and controls the operation of the folding unit 500 by executing various programs stored in the ROM 562 according to instructions given from the CPU circuit block 150.

When the CPU circuit block 560 controls the operation of the folding unit 500, detection signals from various path sensors and cover open/close detecting sensors are taken into the CPU circuit block 560. Drivers 565 and 566 are connected to the CPU circuit block 560; the driver 565 drives motors and solenoids for a conveying function module according to signals from the CPU circuit block 560, while the driver 566 drives motors for a folding function module according to signals from the CPU circuit block 560.

The motors and the solenoids for the conveying function module include a horizontal path conveying motor M1 for driving the conveying rollers 503 and 504 and a solenoid SL1 for selectively turning on/off the path switching flapper 510.

The motors for the folding function module include a folding motor M2 for driving the folding rollers 521 and a folding path conveying motor M3 for driving conveying rollers 527 and 528.

Further, the path sensors include path sensors S1, S2, S3 to detect a delay of a sheet being conveyed and a sheet jam. The cover open/close detecting sensors include cover open/close detecting sensors S4 and S5.

The cover open/close detecting sensor S4 detects the opening/closing of the cover 551. When a detection signal indicative of the opening of the cover 551 is output from the cover open/close detecting sensor S4, power supply of the driver 565 is turned off to shut off power supply to the horizontal path conveying motor M1, so that the conveying function module is forced to stop running. At the same time, power supply of the driver 566 is also turned off to shut off power supply to the folding motor M2 and the folding path conveying motor M3, so that the folding function module is forced to stop running.

The cover open/close detecting sensor S5 detects the opening/closing of the cover 552. When a detection signal indicative of the opening of the cover 551 is output from the cover open/close detecting sensor S5, only power supply of the driver 566 is turned off to shut off power supply to the folding motor M2 and the folding path conveying motor M3, so that the folding function module is forced to stop running.

Further, there are provided a conveying cover lock solenoid SL2 for limiting the opening/closing of the cover 551 and a folding cover lock solenoid SL3 for limiting the opening/closing of the cover 552.

Figure 7:
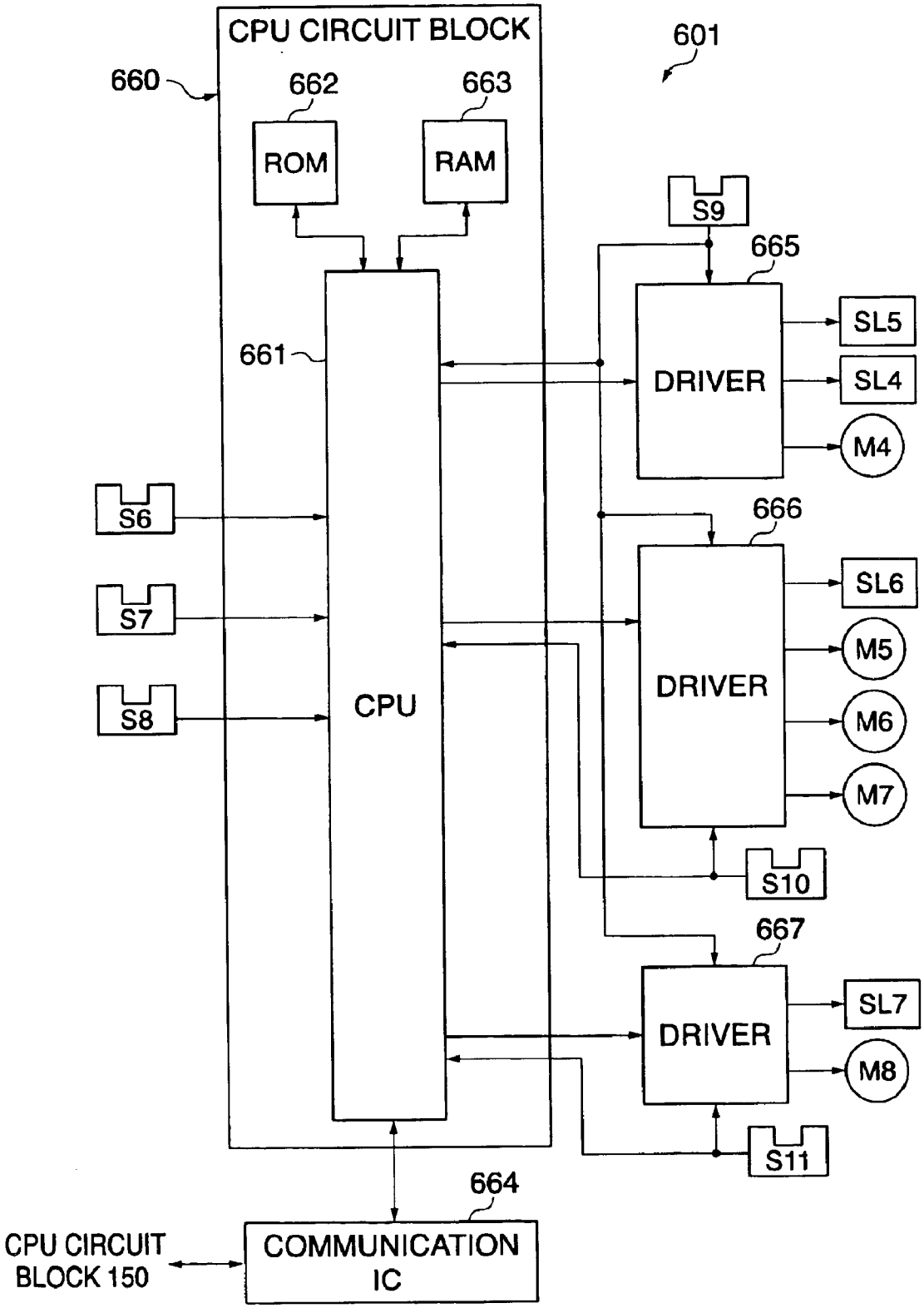
FIG. 7 is a block diagram showing the construction of a book-binding unit controller.

Referring next to FIG. 7, a description will be given of the construction of the book-binding unit controller 601 which controls the operation of the book-binding unit 600. FIG. 7 is a block diagram showing the construction of the book-binding unit controller 601 appearing in FIG. 2.

As shown in FIG. 7, the book-binding unit controller 601 includes a CPU circuit block 660 comprised of a CPU 661, a ROM 662, a RAM 663, and so forth. The CPU circuit block 660 communicates and exchanges data with the CPU circuit block 150, which is provided in the main body 10 of the image forming apparatus, via a communication IC 664, and controls the operation of the book-binding unit 600 by executing various programs stored in the ROM 662 according to instructions given from the CPU circuit block 150.

When the CPU circuit block 660 controls the operation of the book-binding unit 600, detection signals from various path sensors and cover open/close detecting sensors are taken into the CPU circuit block 660. Drivers 665, 666, and 667 are connected to the CPU circuit block 660; the driver 665 drives motors and solenoids for a conveying function module according to signals from the CPU circuit block 660, the driver 666 drives motors for a book-binding function module according to signals from the CPU circuit block 660, and the driver 667 drives motors for a stacking function module according to signals from the CPU circuit block 660.

The motor and the solenoids for the conveying function module include a horizontal path conveying motor M4 for driving the conveying rollers 602, 603, and 604, and a solenoid SL4 for selectively turning on/off the book-binding path selecting flapper 610.

The motors for the book-binding function module include a folding motor M5 for driving the folding rollers 620, a folding path conveying motor M7 for driving the conveying rollers 605, and a positioning motor M6 for driving the sheet positioning member 625.

The motors for the stacking function module include a tray lifting motor M8 for driving the book-binding discharge tray 630.

Further, the path sensors include path sensors S6, S7, and S8 to detect a delay of a sheet being conveyed and a sheet jam. The cover open/close detecting sensors include cover open/close detecting sensors S9, S10, and S11.

The cover open/close detecting sensor S9 detects the opening/closing of the cover 651. When a detection signal indicative of the opening of the cover 651 is output from the cover open/close detecting sensor S9, power supply of the driver 665 is turned off to shut off power supply to the horizontal path conveying motor M4, so that the conveying function module is forced to stop running. At the same time, power supply of the drivers 666 and 667 is also turned off to shut off power supply to the folding motor M5, positioning motor M6, folding path conveying motor M7, and tray lifting motor M8, so that the entire book-binding unit 600 is forced to stop running.

The cover open/close detecting sensor S10 detects the opening/closing of the cover 652. When a detection signal indicative of the opening of the cover 652 is output from the cover open/close detecting sensor S10, only power supply of the driver 666 is turned off to shut off power supply to the folding motor M5, positioning motor M6, and folding path conveying motor M7, so that the book-binding function module is forced to stop running.

The cover open/close detecting sensor S11 detects the opening/closing of a cover 653. When a detection signal indicative of the opening of the cover 653 is output from the cover open/close detecting sensor S11, only power supply of the driver 667 is turned off to shut off power supply to the tray lifting motor M8, so that the stacking function module is forced to stop running.

Further, there are provided a conveying cover lock solenoid SL5 for limiting the opening/closing of the cover 651, a binding cover lock solenoid SL6 for limiting the opening/closing of the cover 652, and an ejecting cover lock solenoid SL7 for limiting the opening/closing of the cover 653.

Figure 8:
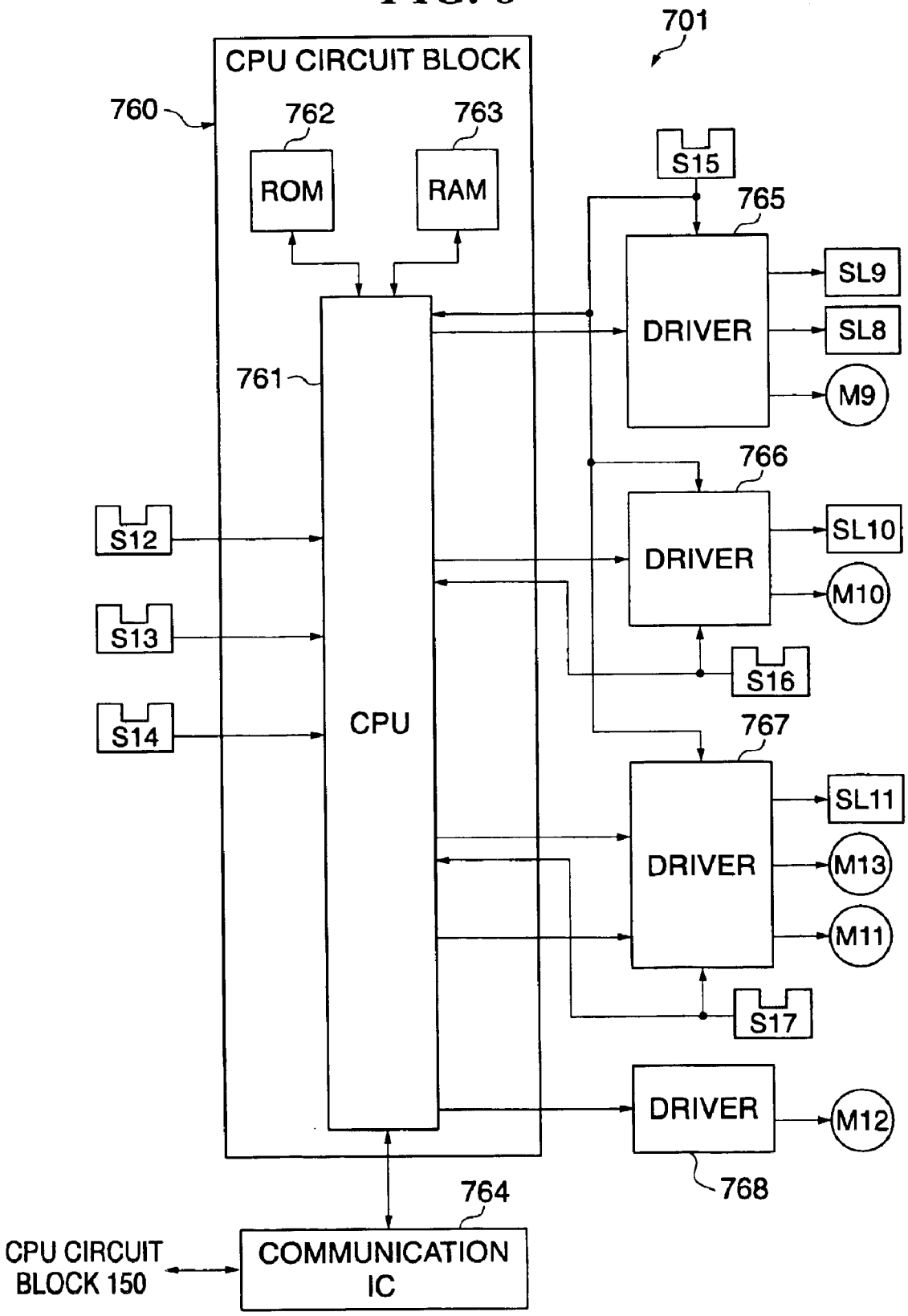
FIG. 8 is a block diagram showing the construction of a finisher controller.

Referring next to FIG. 8, a description will be given of the construction of the finisher controller 701 which controls the operation of the finisher 700. FIG. 8 is a block diagram showing the construction of the finisher controller 701 appearing in FIG. 2.

As shown in FIG. 8, the finisher controller 701 includes a CPU circuit block 760 comprised of a CPU 761, a ROM 762, a RAM 763, and so forth. The CPU circuit block 760 communicates and exchanges data with the CPU circuit block 150, which is provided in the main body 10 of the image forming apparatus, via a communication IC 764, and controls the operation of the finisher 700 by executing various programs stored in the ROM 762 according to instructions given from the CPU circuit block 150.

When the CPU circuit block 760 controls the operation of the finisher 700, detection signals from various path sensors and cover open/close detecting sensors are taken into the CPU circuit block 760. Drivers 765, 766, 767, and 768 are connected to the CPU circuit block 760; the driver 765 drives motors and solenoids for a conveying function module according to signals from the CPU circuit block 760, the driver 766 drives motors for a non-sort discharging function module according to signals from the CPU circuit block 760, the driver 767 drives motors for a sort discharging function module according to signals from the CPU circuit block 660, and the driver 768 drives motors for a stacking function module according to a signal from the CPU circuit block 760.

The motors and the solenoids for the conveying function module include a conveying motor M9 for driving the inlet rollers 702, and a solenoid SL8 for selectively turning on/off the path switching flapper 710.

The motors for the non-sort discharging function include a non-sort discharging motor M10 for driving the conveying rollers 706 and the non-sort discharging rollers 703.

The motors for the sort discharging function module include a sort discharging motor M13 for driving the sort discharging rollers 704, and a bundle conveying motor M11 for driving the bundle discharging rollers 705*a* and 705*b*.

The motors for the stacking function module include a tray lifting motor M12 for driving the stack tray 722.

The conveying motor M9, a non-sort discharging motor M10, and a sort discharging motor M13 are implemented by stepping motors and capable of rotating a pair of rollers at the same speed or different speeds by controlling the rate of excitation pulse rate. The bundle conveying motor M11 is implemented by a DC motor.

Further, the path sensors include path sensors S12, S13, and S14 to detect a delay of a sheet being conveyed and a sheet jam. The cover open/close detecting sensors include cover open/close detecting sensors S15, S16, and S17.

The cover open/close detecting sensor S15 detects the opening/closing of the cover 751. When a detection signal indicative of the opening of the cover 751 is output from the cover open/close detecting sensor S15, power supply of the driver 765 is turned off to shut off power supply to the conveying motor M9, so that the conveying function module is forced to stop running. At the same time, power supply of the drivers 766, 767, and 768 is also turned off to shut off power supply to the non-sort discharging motor M10, sort discharging motor M13, bundle conveying motor M11, and tray lifting motor M12, so that the entire finisher 700 is forced to stop running.

The cover open/close detecting sensor S16 detects the opening/closing of the cover 752. When a detection signal indicative of the opening of the cover 752 is output from the cover open/close detecting sensor S16, power supply of the driver 766 is turned off to shut off power supply to the non-sort discharging motor M10, so that only the non-sort discharging function module is forced to stop running.

The cover open/close detecting sensor S17 detects the opening/closing of the cover 753. When a detection signal indicative of the opening of the cover 753 is output from the cover open/close detecting sensor S17, only power supply of the driver 767 is turned off to shut off power supply to the sort discharging motor M13 and the bundle conveying motor M11, so that only the sort discharging function module is forced to stop running.

Further, there are provided a conveying cover lock solenoid SL9 for limiting the opening/closing of the cover 751, a non-sort cover lock solenoid SL10 for limiting the opening/cover of the cover 752, and a sort cover lock solenoid SL11 for limiting the opening/closing of the cover 753.

Figure 9A:
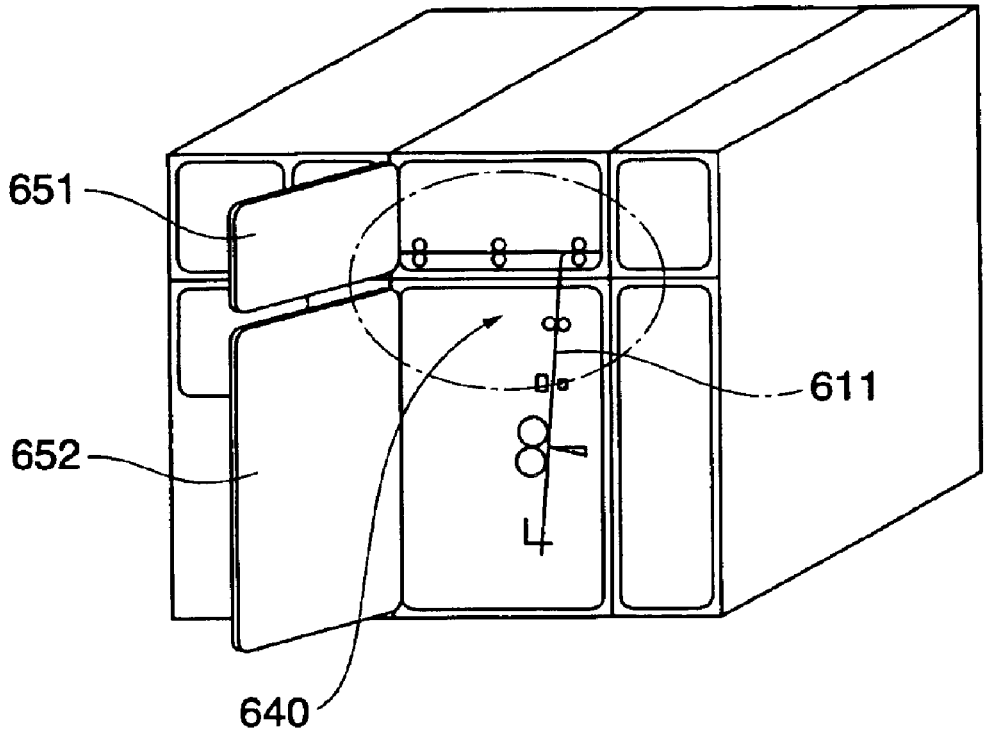
FIGS. 9A and 9B are views useful in explaining how a function module is taken out from a sheet processing apparatus.
Figure 9B:
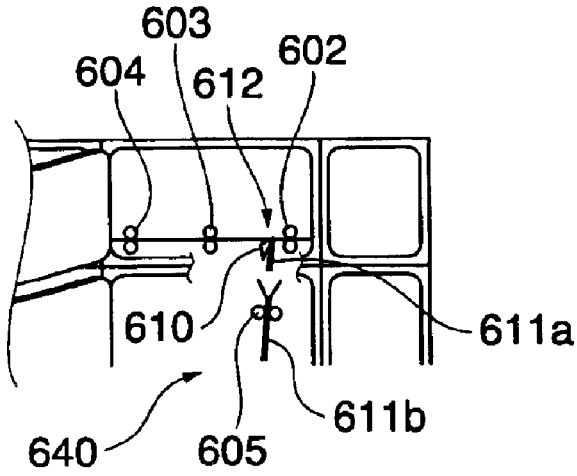

FIG. 9A is a perspective view showing in detail a part where the binding horizontal path section and the book-binding processing section 640 are joined together. FIG. 9B is an enlarged view showing a part of FIG. 9A on an enlarged scale. The book-binding path 611 is divided into an upper part 611*a* provided in the binding horizontal path section and a lower part 611*b* provided in the book-binding processing section 640. The book-binding path selecting flapper 610 is provided in the book-binding horizontal path section.

Figure 10:
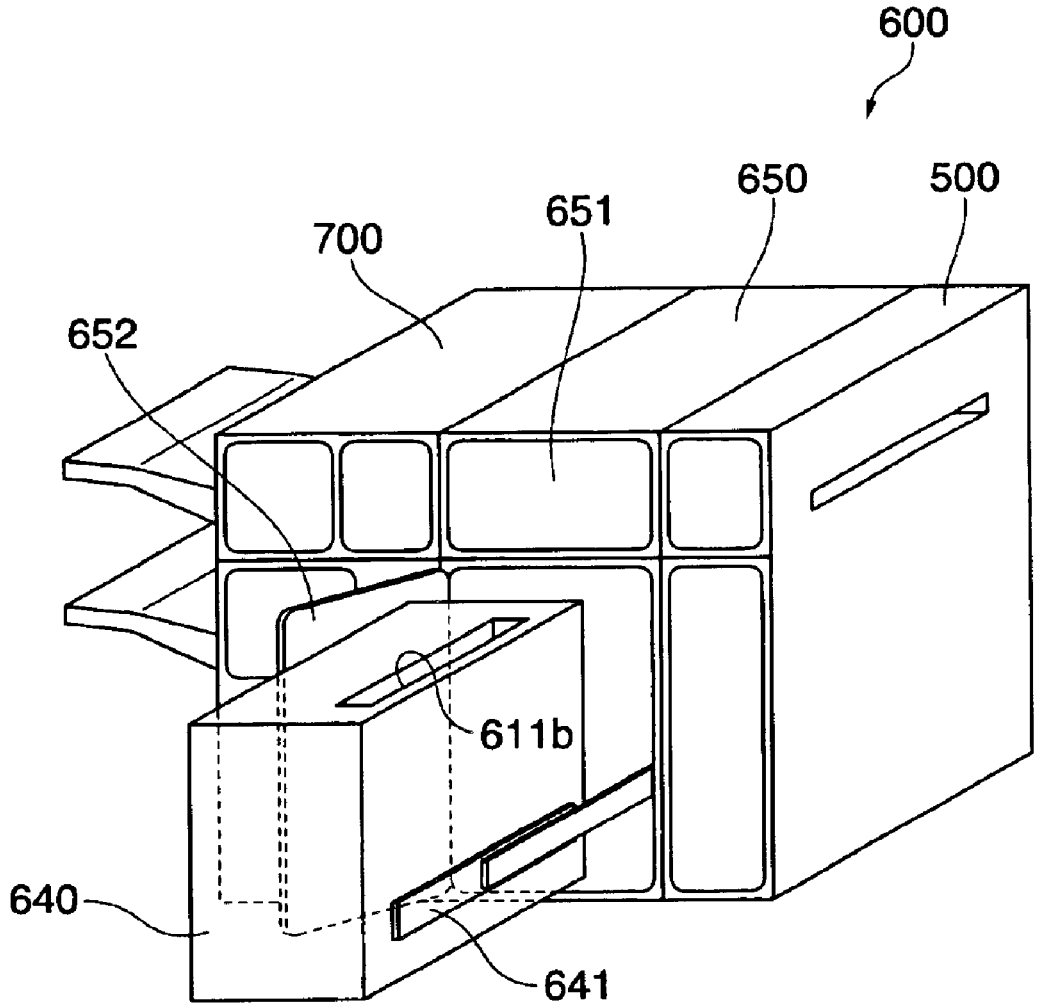
FIG. 10 is a view useful in explaining how a function module is taken out from the sheet processing apparatus.

FIG. 10 is a perspective view showing a state in which the cover 652 is opened and the book-binding processing section 650 is pulled out of the main body of the book-binding unit 600. The book-binding processing section 640 is connected to the main body of the book-binding unit 600 via two slide rails 641 formed at the right and left side walls thereof so that the book-binding processing section 640 can be pulled out of the main body of the book-binding unit 600. When the book-binding processing section 640 is pulled out of the main body of the book-binding unit 600, the lower part 611*b* of the book-binding path 611*b* as well as all of the conveying rollers 605, stapler 615, folding rollers 620, and so forth are also pulled out of the main body of the book-binding unit 600.

Figure 11:
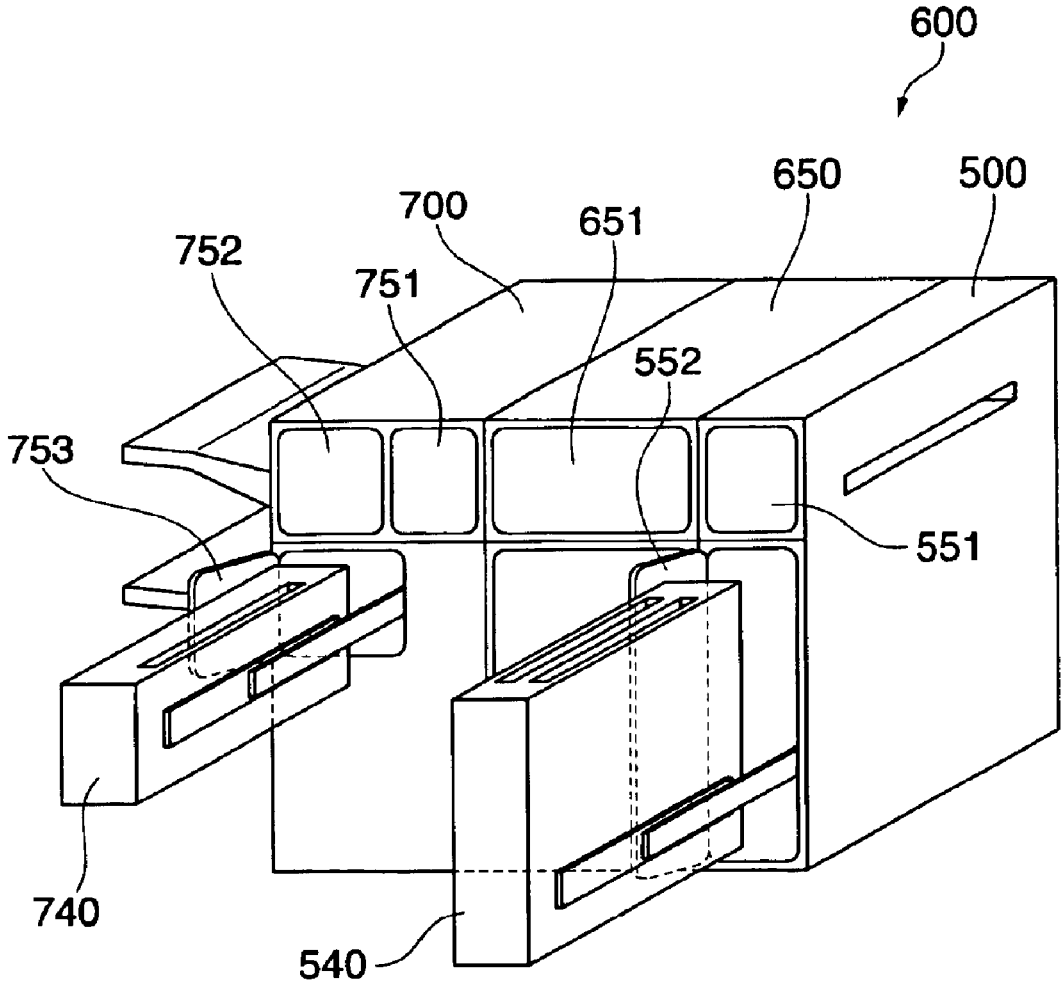
FIG. 11 is a diagram useful in explaining how function modules are taken out from other sheet processing apparatuses.

FIG. 11 is a perspective view showing a state in which the folding processing section 540 of the folding unit 500 and the sorting processing section 740 of the finisher 700 are pulled out of the respective main bodies of the folding unit 500 and the finisher 700. As is the case with the book-binding processing section 640, the folding processing section 540 and the sorting processing section 740 can be pulled out by opening the respective covers 552 and 753.

Figure 12:
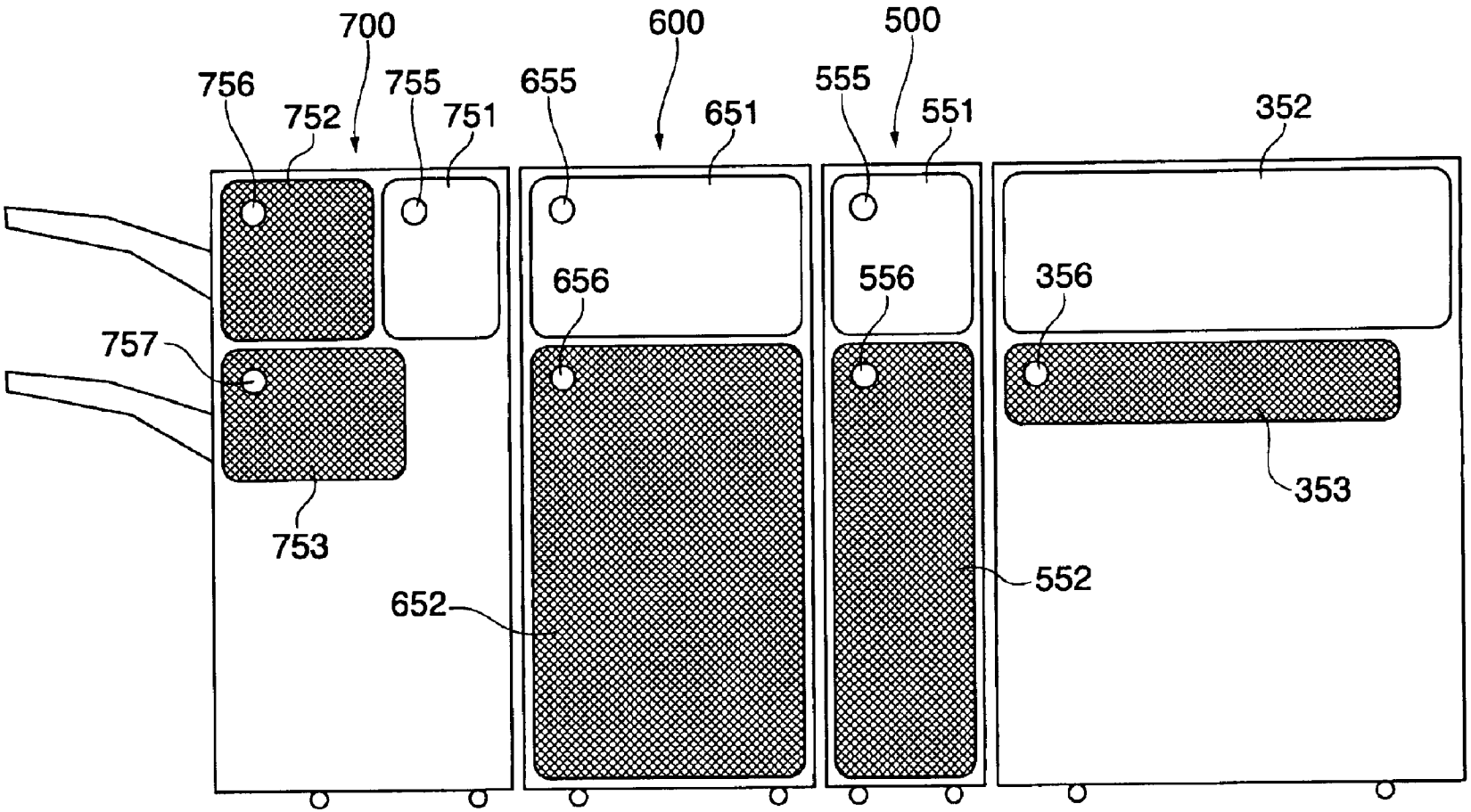
FIG. 12 is a view showing LEDs provided in upper parts of respective covers of the sheet processing apparatuses.

As shown in FIG. 12, each of the above described covers is provided with an LED for indicating the status of the cover (i.e. LEDs 555 and 556 for the folding unit 500, LEDs 655 and 656 for the book-binding unit 600, and LEDs 755, 756 and 757 for the finisher 700). During image formation, each LED indicates whether maintenance is allowed to be performed, i.e. whether the corresponding cover is permitted to be opened and closed. If maintenance is allowed to be performed, the corresponding LED is off, and on the other hand, if maintenance is not allowed to be performed, each LED is on.

Alternatively, each LED may light up in different colors according to whether maintenance is allowed to be performed or not.

Figure 13:
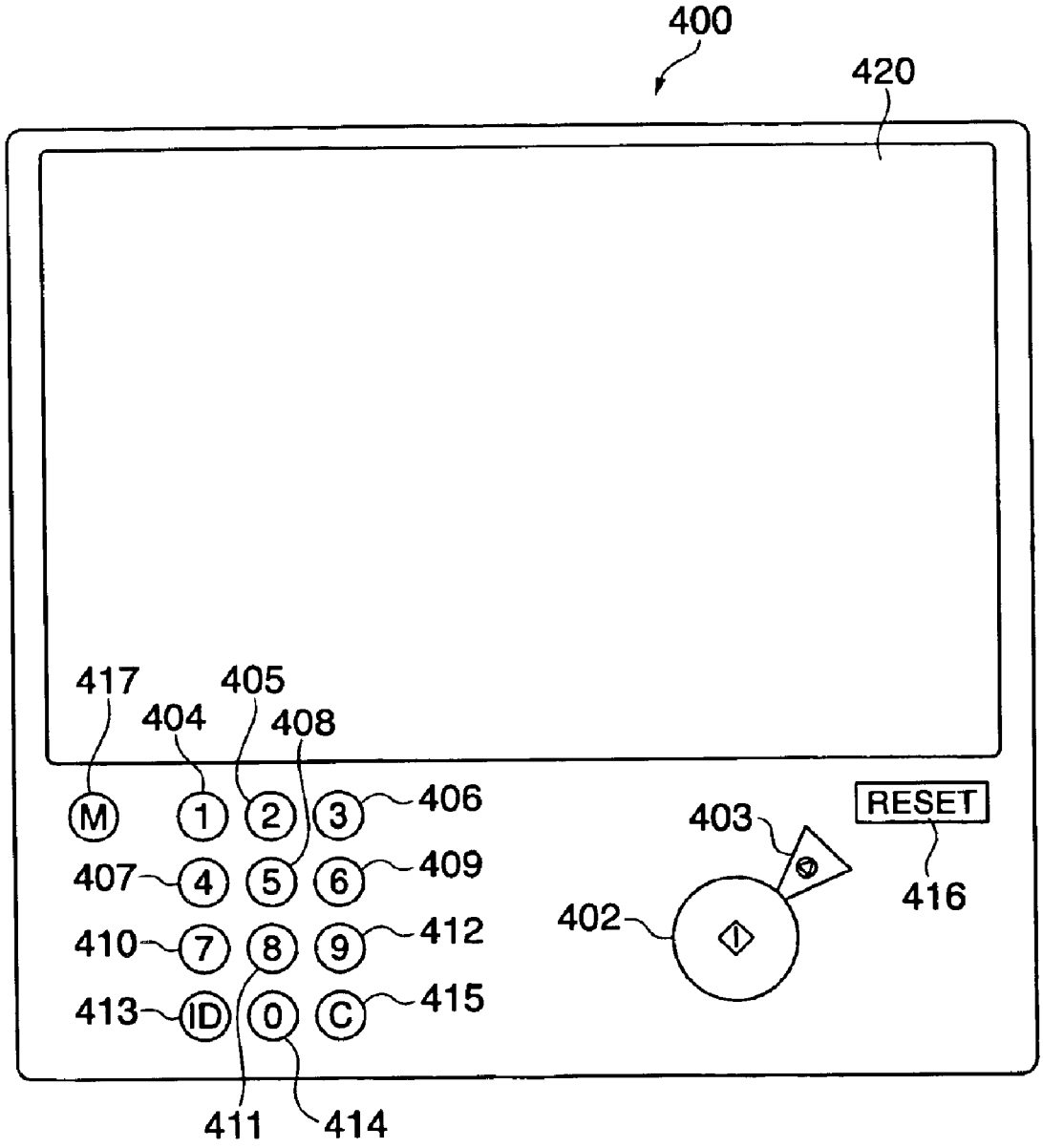
FIG. 13 is a view useful in explaining an operation and display unit.

FIG. 13 is a view showing the operation and display unit 400 of the image forming apparatus appearing in FIG. 1.

The operation and display unit 400 has a start key 402 for starting an image forming operation, a stop key 403 for stopping an image forming operation, ten-keys 404 to 412 and 414 for setting the number of copies, an ID key 413, a clear key 415, a reset key 416, a maintenance key 417, and so forth. Further, a liquid crystal display 420 of touch-sensitive panel type is disposed at an upper part of the operation and display unit 400 so that soft keys can be created on a screen displayed on the liquid crystal display 420.

Figure 14A:
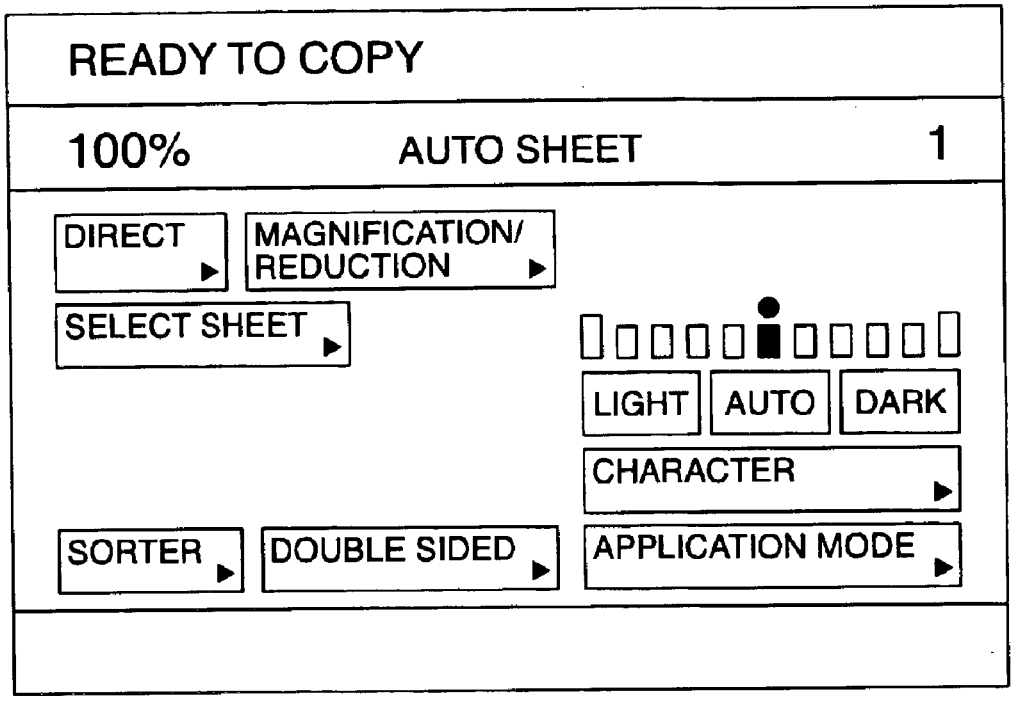
FIGS. 14A and 14B are views showing screens displayed on a display section.
Figure 14B:
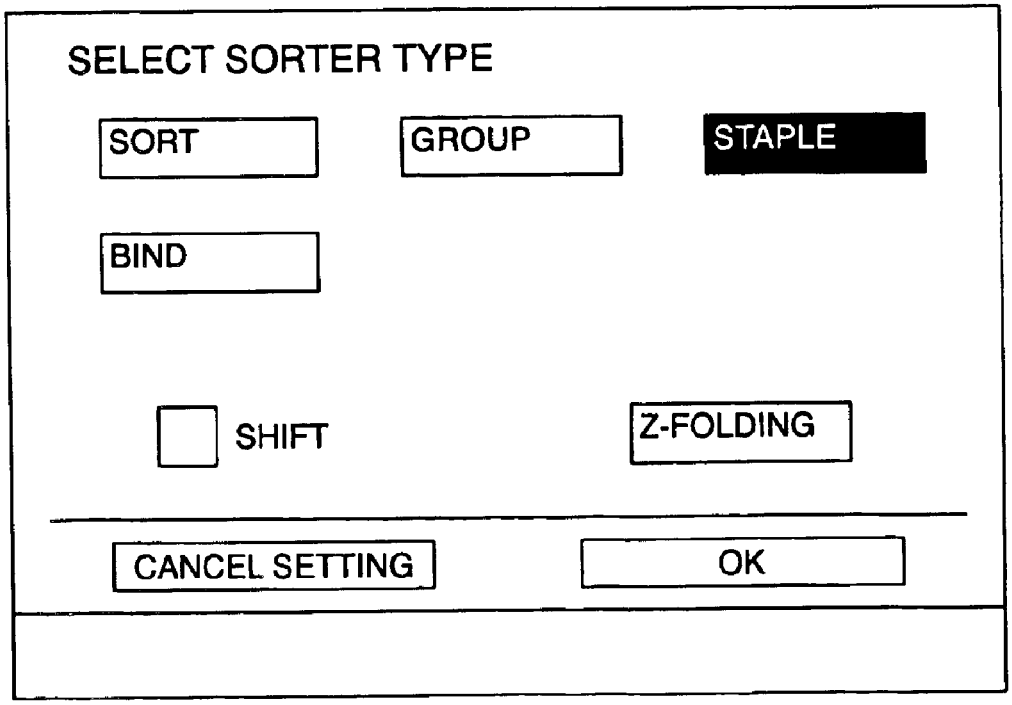

The image forming apparatus according to the present embodiment has a variety of post-processing modes such as a non-sort (group) mode, a sort mode, a staple sort mode (staple mode), and a book-binding mode. These processing modes are input through the operation of the operation and display unit 400. For example, to set any post-processing mode, a soft key "SORTER" is selected on an initial screen appearing in FIG. 14A to display a menu selecting screen appearing in FIG. 14B. The post-processing mode is set using the menu selecting screen.

Figure 15:
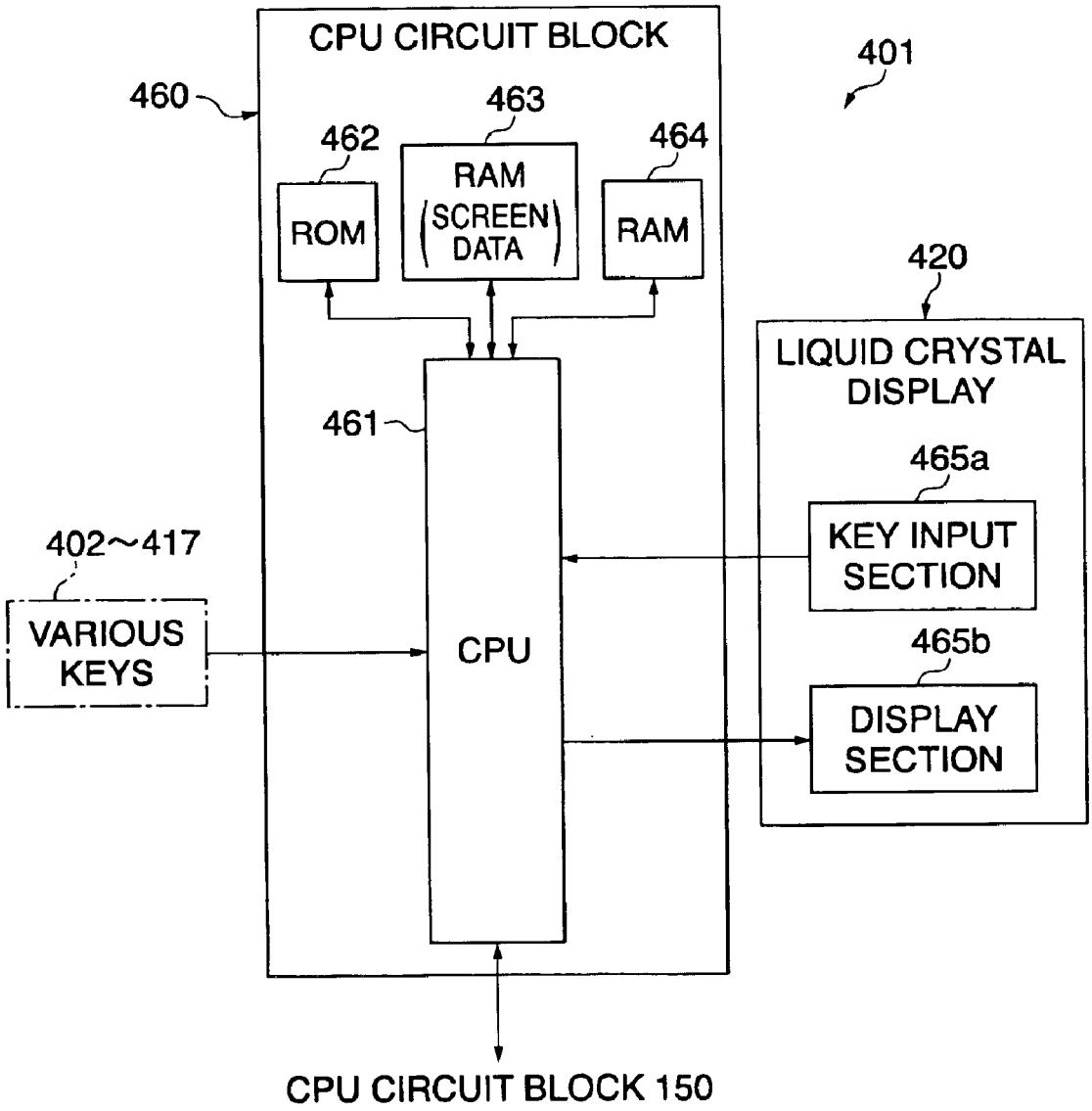
FIG. 15 is a block diagram showing the construction of the operation and display unit.

FIG. 15 is a block diagram showing the configuration of the operation and display unit controller 401 appearing in FIG. 2.

As shown in FIG. 15, the operation and display unit controller 401 includes a CPU circuit block 460 comprised of a CPU 461, a ROM 462, RAMs 463 and 464, and so forth. The RAM 463 is used as e.g. a work area for operations performed by the CPU 461. The liquid crystal display 420 is comprised of a key input section 465*a* composed of soft keys on a touch-sensitive panel, and a display section 465*b*.

The CPU circuit block 460 communicates and exchanges data with the CPU circuit block 150 provided in the main body 10 of the image forming apparatus, executes various programs stored in the ROM 462 according to instructions given from the CPU circuit block 150 and settings made through the operation of the keys 402 to 417 and the key input section 465*a*, and outputs screen data stored in the RAM 463 to the display section 465*b* so that the screen data can be displayed.

Referring next to FIGS. 16A and 16B, and 17A to 17D, a description will be given of the panel layout of the screen displayed by the liquid crystal display 420 during maintenance.

Figure 16A:
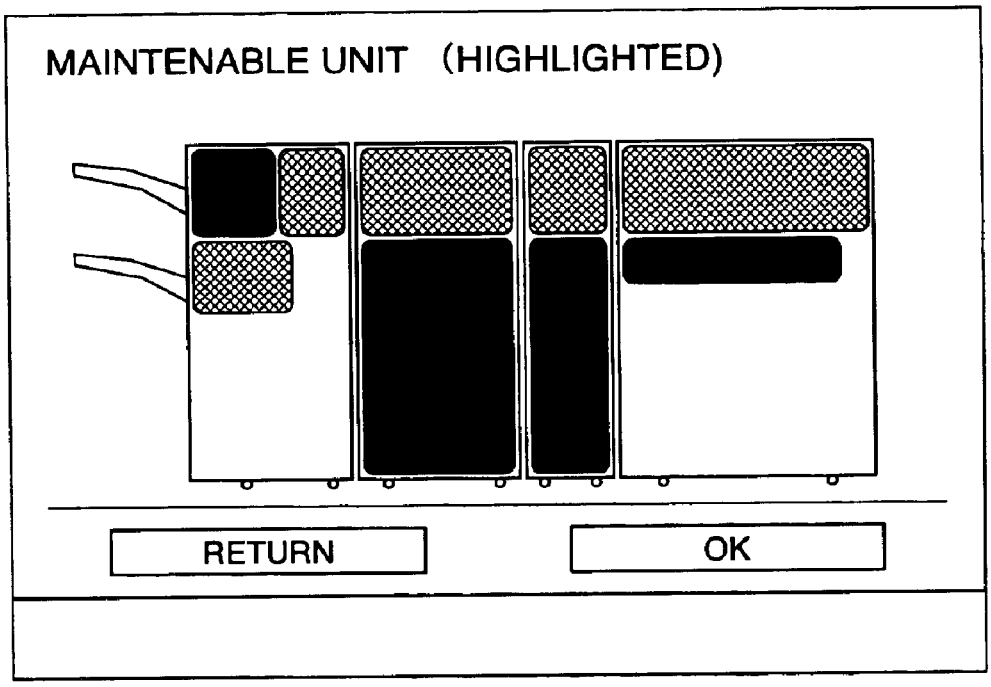
FIGS. 16A and 16B are views showing screens displayed on the display section in a maintenance mode.

In the operation and display unit 400, when the user depresses the maintenance key 417, the operation and display unit controller 401 displays whether each device connected to the liquid crystal display 420 can be subjected to maintenance or not (FIG. 16A).

Here, according to settings as to various kinds of processing, the covers for conveying paths or function modules not to be used are permitted to be opened and closed and the liquid crystal display 420 displays that they can be subjected to maintenance. The conveying paths and the function modules which can be subjected to maintenance by the user opening the corresponding covers are highlighted, while the conveying paths or function modules which cannot be subjected to maintenance are hatched.

When the user depresses an "OK" key on the touch-sensitive panel on the liquid crystal display 420 after checking the modules which can be subjected to maintenance on a screen appearing in FIG. 16A, a maintenance selecting screen (FIG. 17A) is displayed.

Figure 17A:
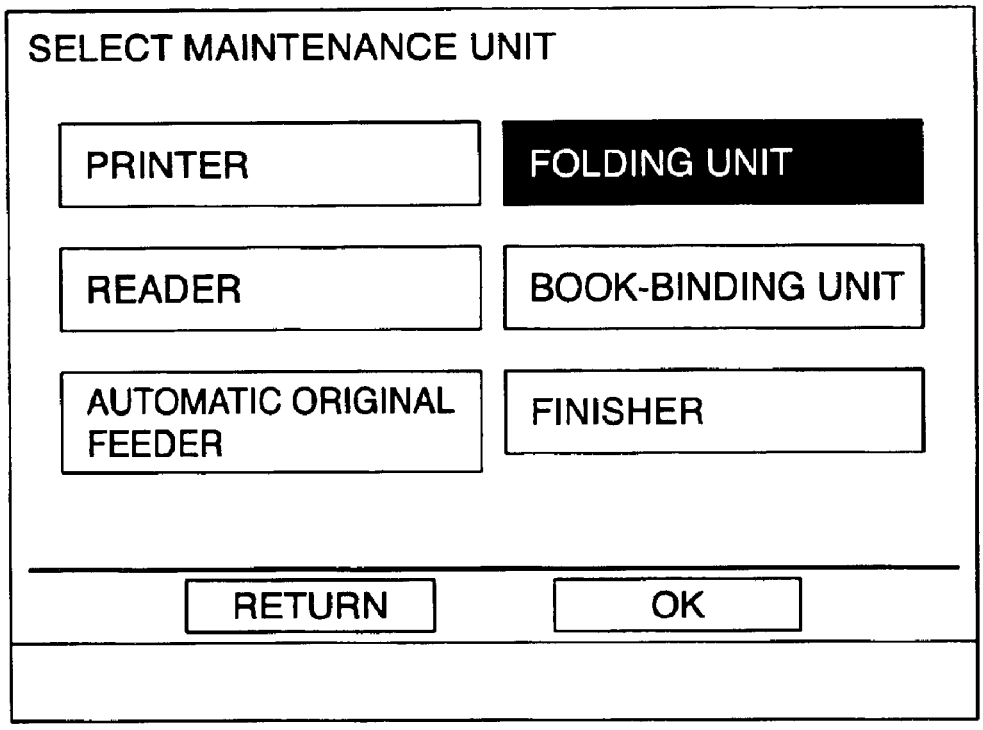
FIGS. 17A to 17D are views showing screens displayed on the display section.
Figure 17B:
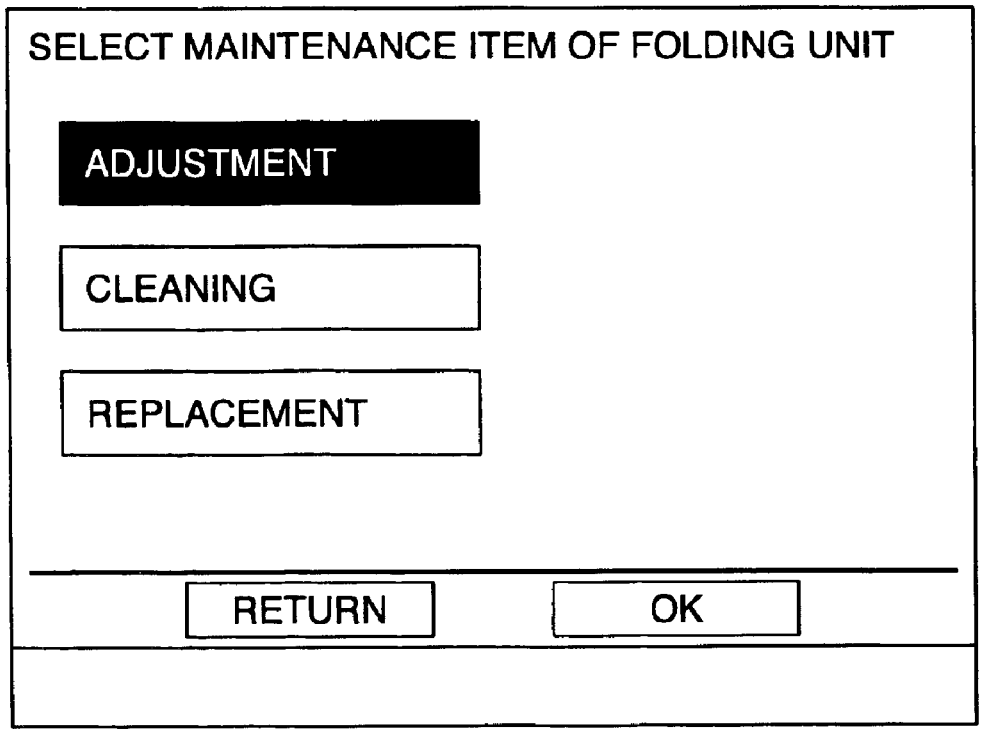
Figure 17C:
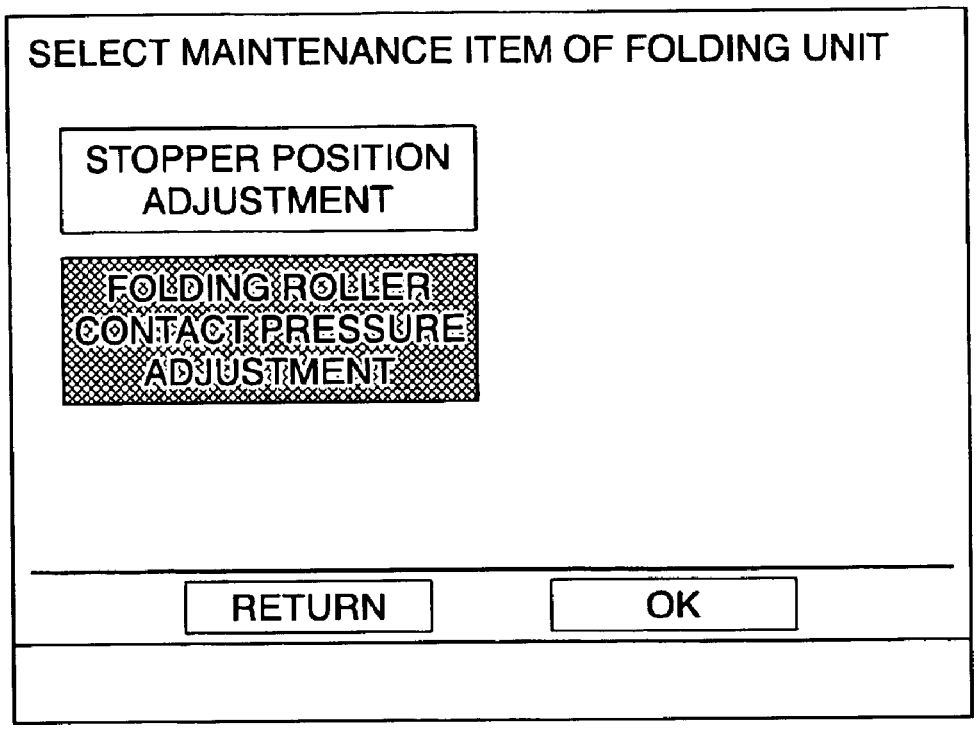
Figure 17D:
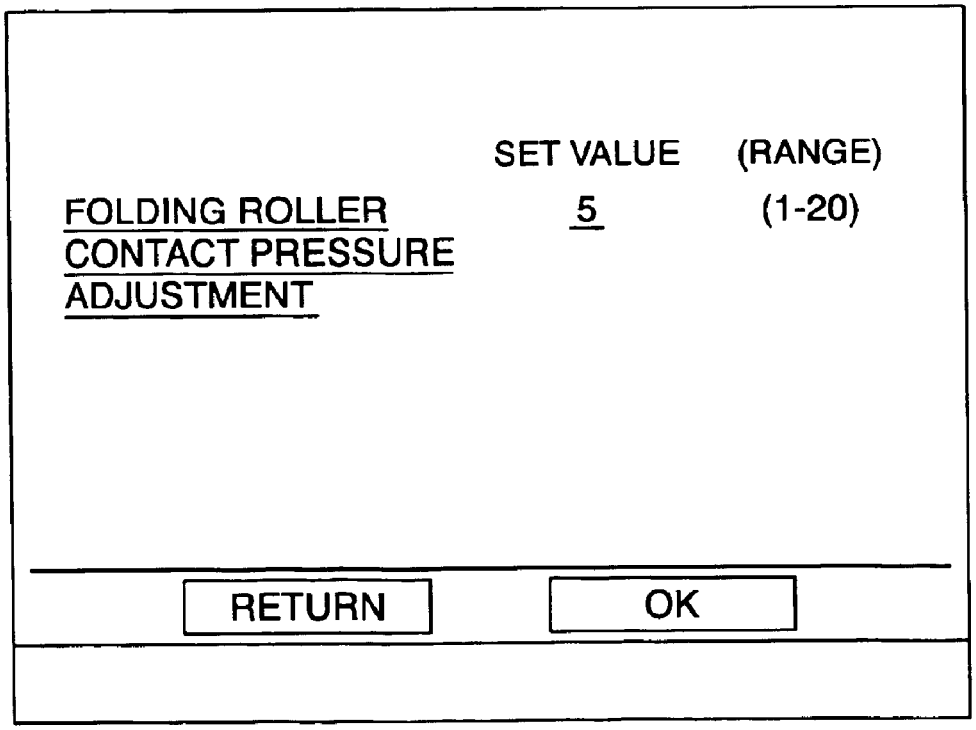

All the modules required to be subjected to maintenance are displayed as a selection menu. On the selecting screen appearing in FIG. 17A, when the user depresses a soft key on the touch-sensitive panel on the liquid crystal display 420 to select a module which is to be subjected to maintenance from modules which can be selected, a selecting screen showing a menu of maintenance items relating to the module selected by the user is displayed (FIG. 17B). On the selecting screen appearing in FIG. 17B, when the user depresses the touch-sensitive panel on the liquid crystal display 420 to select a maintenance item, a selecting screen showing the details of the selected maintenance item is displayed (FIG. 17C). On the selecting screen appearing in FIG. 17C, when the user depresses a soft key on the touch-sensitive panel on the liquid crystal display 420 to select a maintenance item, a screen for setting and executing the selected maintenance item is displayed (FIG. 17D).

FIG. 18 is a view showing a table which indicates which covers are permitted to be opened and closed according to settings as to various processes (one-sided printing, double-sided printing, sorting process, folding process, and binding process). It is assumed here that the covers for conveying paths not to be used or function modules not to be used are permitted to be opened and closed, while the covers for conveying paths to be used or function modules to be used are not permitted to be opened and closed. The information shown in FIG. 18 is usually stored in the ROM 151, but may be stored in the ROM 562, ROM 662, or ROM 762. In the following description, the screens appearing in FIGS. 16A and 16B will be taken as examples.

The screen appearing in FIG. 16A indicates the parts which can be subjected to maintenance or not, i.e. which covers are permitted to be opened and closed among a plurality of covers. The parts whose covers are permitted to be opened are highlighted, while the parts which are not permitted to be opened are hatched. FIG. 16A shows an example in which the sorting process is selected in the case where a one-sided printing mode is set. This corresponds to "ONE-SIDED PRINTING/SORTING" in FIG. 18. Since the printer 300 is in the one-sided printing mode, the cover 353 for the double-sided printing function module section not to be used is highlighted, and the cover 352 for a image forming section of the printer 300 to be used is hatched. Regarding the folding unit 500 and the book-binding unit 600, the covers 551 and 651 for the horizontal paths 502 and 612 which convey a sheet with an image formed thereon are hatched, while the covers 552 and 652 for the folding processing section 540 and the book-binding processing section 640, which are not to be used, are highlighted. Regarding the finisher 700, since the sheet is conveyed on the finisher path 711 and discharged onto the intermediate tray 730 and the stack tray 722 via the sorting path 713, the covers 751 and 753 are hatched, while the cover 752 is highlighted.

Figure 16B:
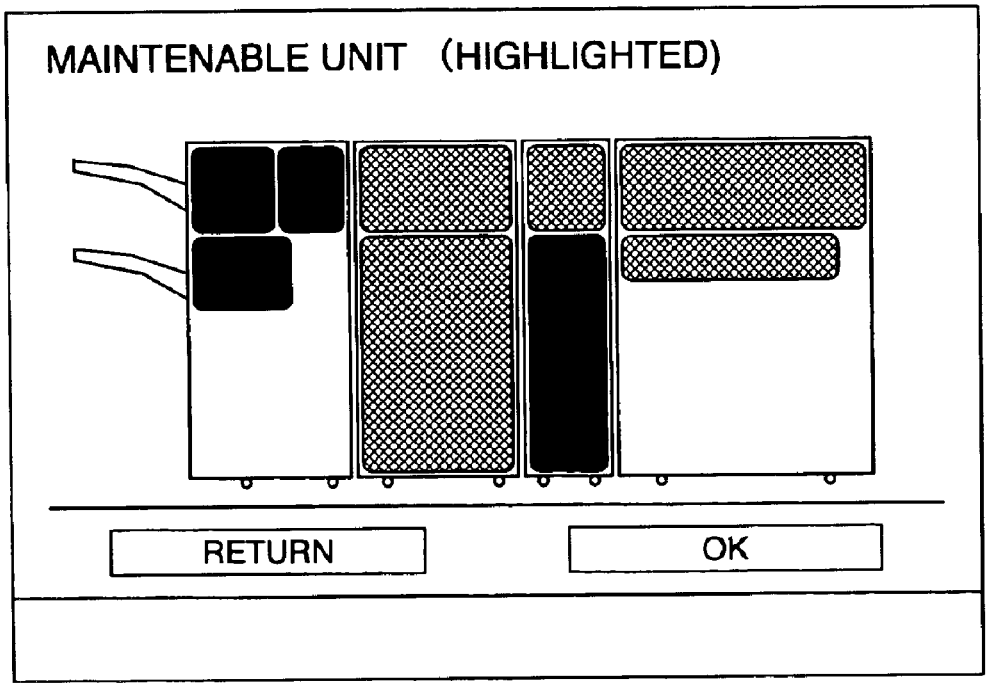

A description will now be given of an unusual case where a sheet does not pass through the finisher 700 and a book-binding processing is carried out. This corresponds to "BOOK-BINDING" in FIG. 18. If it is configured such that saddle stitching is carried out using the book-binding unit 600, a screen appearing in FIG. 16B is displayed. In the case where saddle stitching is carried out, printing is automatically performed in the double-sided printing mode, and hence the cover 352 for the image forming section and the cover 353 for the double-sided printing function module are hatched. Regarding the folding unit 500, the cover 551 for the horizontal path 502 is hatched and the cover 552 for the folding processing section 540 not to be used is highlighted. Regarding the book-binding unit 600 which is set to carry out saddle stitching, both the cover 651 for the horizontal path 612 and the cover 652 for the book-binding processing section 640 are hatched. A bundle of sheets which are bound together by saddle stitching using the book-binding unit 600 is discharged onto the book-binding discharge tray 630. As a result, the sheets are not conveyed to the finisher 700, and hence even the cover 751 for a common conveying path through which all of sheets conveyed into the finisher 700 pass is highlighted since the finisher 700 can be subjected to maintenance. The covers 752 and 753 are highlighted, too.

Figure 19:
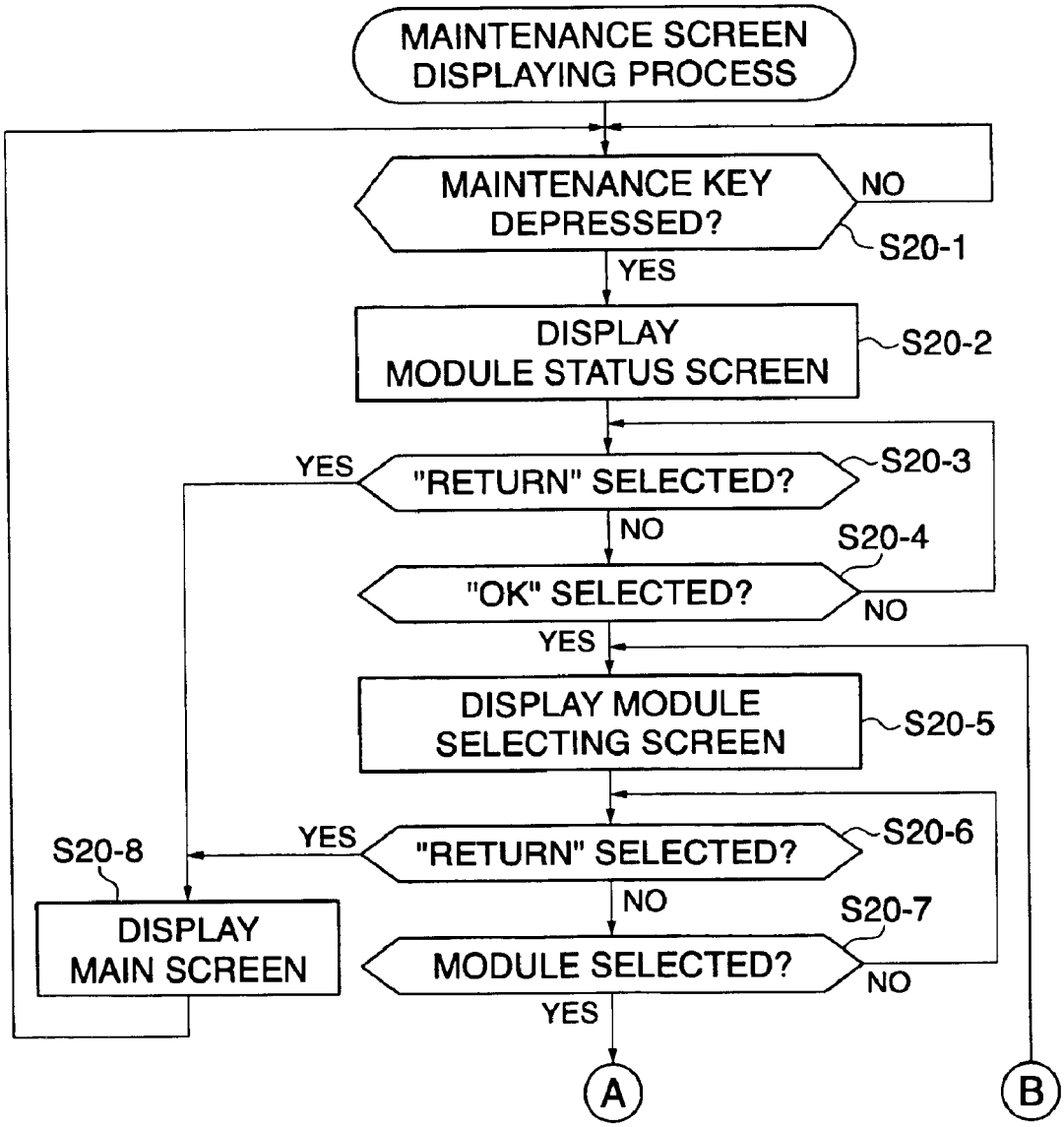
FIG. 19 is a flow chart showing the procedure of a display process for displaying a maintenance screen.
Figure 20A:
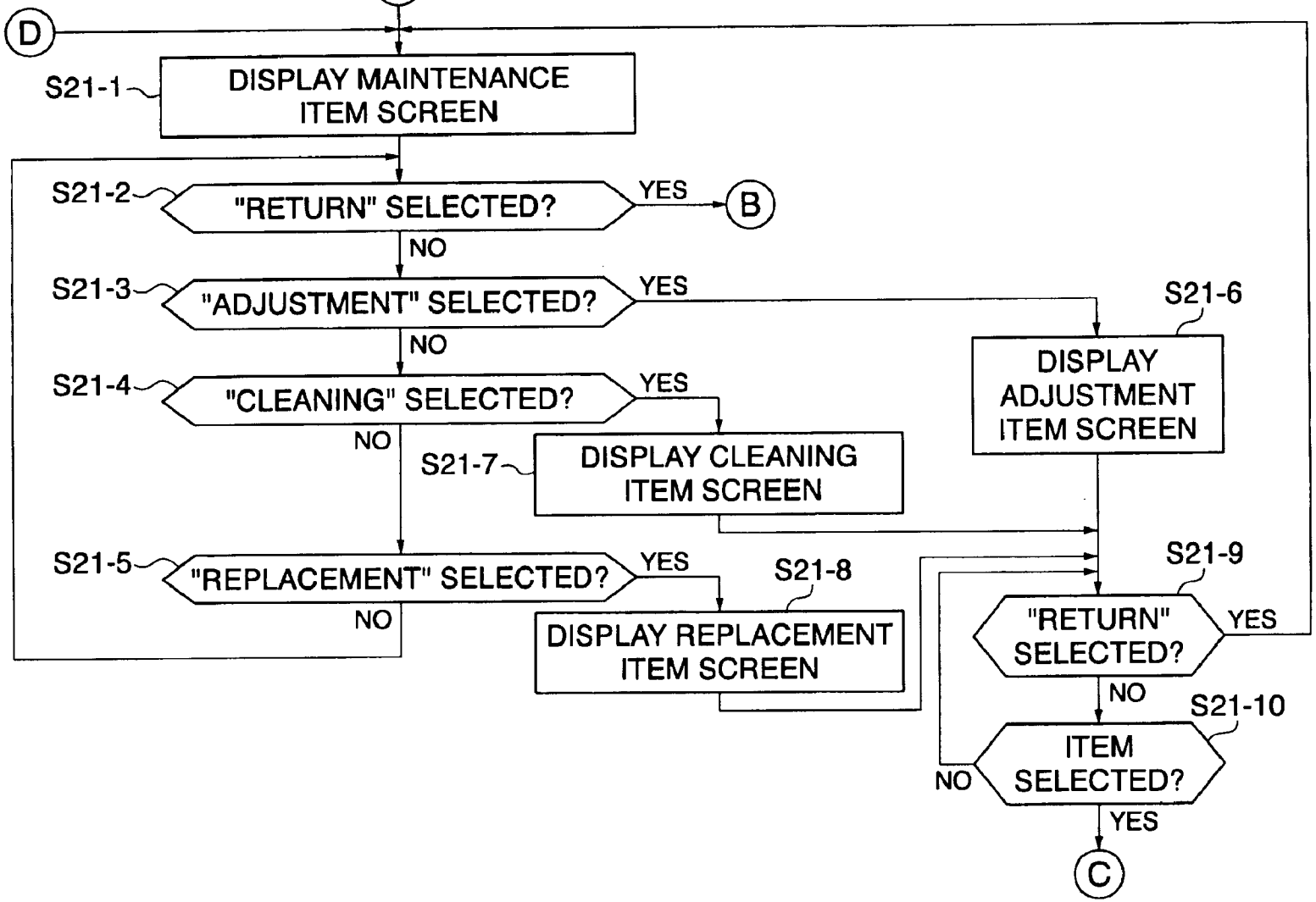
FIGS. 20A and 20B are continued parts of the flow chart in FIG. 19.
Figure 20B:
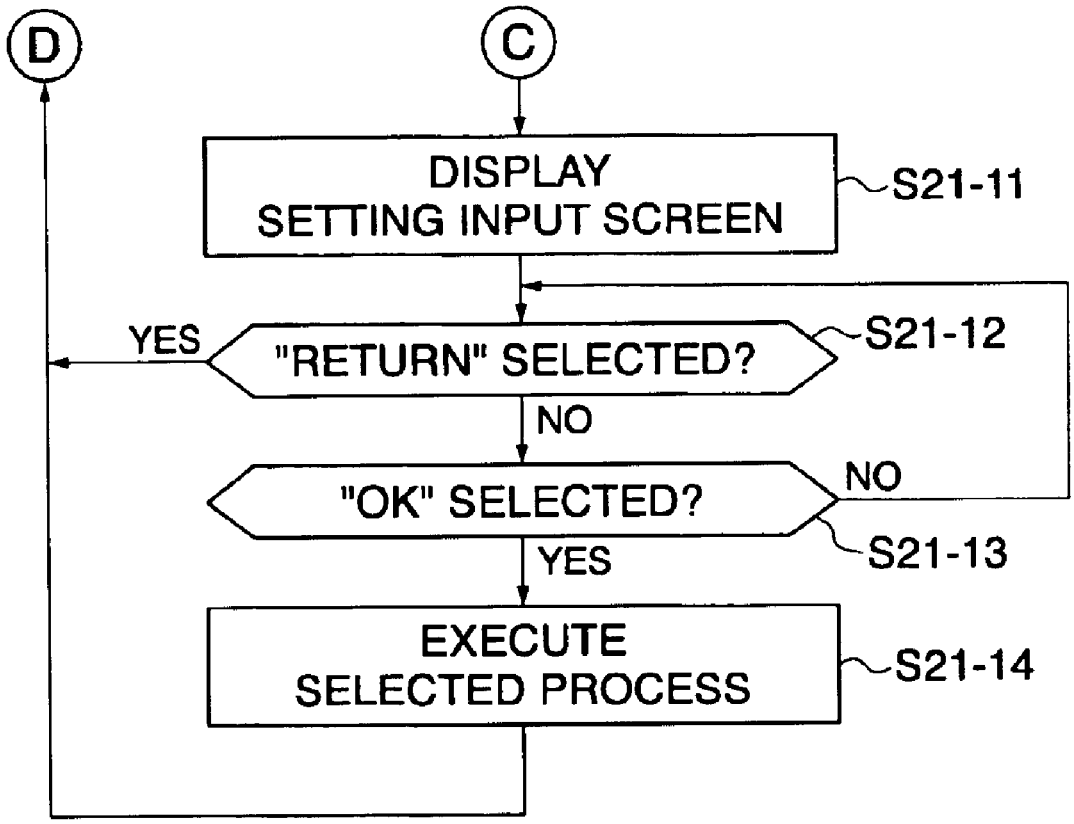

FIGS. 19, and 20A and 20B are flow charts showing a procedure for displaying a maintenance screen.

In a step S20-1, if the CPU 461 determines that the user has depressed the maintenance key 417 of the operation and display unit 400, a step S20-2 is executed. The CPU 461 displays a module status screen (FIG. 16A) for the user to ascertain whether maintenance is allowed to be performed on each module or not. If it is determined that "RETURN" has been selected on the module status screen (FIG. 16A), a step S20-8 is executed. If it is determined that "RETURN" has not been selected on the module status screen (FIG. 16A), it is then determined whether "OK" has been selected or not (step S20-4). If it is determined in the step S20-4 that "OK" has not been selected, the step S20-3 is executed again. If it is determined in the step S20-4 that "OK" has been selected, a step S20-5 is executed.

Then, the module selecting screen (FIG. 17A) for selecting a module is displayed (step S20-5). The CPU 461 then determines whether "RETURN" has been selected or not (step S20-6). If it is determined in the step S20-6 that the user has selected "RETURN" on the module selecting screen (FIG. 17A), it is then determined whether any module has been selected or not (step S20-7). If it is determined in the step S20-7 that any module has been selected, a step S21-1 is executed. If it is determined in the step S20-7 that no module has been selected, the step S20-6 is executed again.

In the step S21-1, the CPU 461 displays a menu of maintenance items (FIG. 17B) relating to the module selected by the user in the step S20-7. The CPU 461 then determines whether "RETURN" has been selected or not (step S21-2).

If it is determined in the step S21-2 that the user has selected "RETURN" on the screen showing the menu of maintenance items (FIG. 17B), the step S20-5 is executed. If it is determined in the step S21-2 that the user has not selected "RETURN", it is then determined whether the user has selected adjustment items to be displayed or not (S21-3).

If determining in the step S21-3 whether the user has selected adjustment items to be displayed, the CPU 461 provides control to display a menu of adjustment items (FIG. 17C) relating to the module selected by the user (step S21-6), and then executes a step S21-9.

If determining in the step S21-3 that the user has not selected adjustment items to be displayed on the screen showing the menu of maintenance items (FIG. 17B), the CPU 461 then determines whether the user has decided to display cleaning items or not (S21-4).

If determining in the step S21-4 that the user has selected cleaning items to be displayed, the CPU 461 provides control to display a menu of cleaning items, not shown, relating to the module selected by the user (step S21-7), and then executes a step S21-9. On the other hand, if determining in the step 21-4 that the user has selected cleaning items to be displayed on the screen showing the menu of maintenance items (FIG. 17B), the CPU 461 determines whether the user has selected replacement items to be displayed or not (step S21-5).

If determining in the step S21-5 that the user has selected replacement items to be displayed, the CPU 461 provides control to display a menu of replacement items, not shown, relating to the module selected by the user (step S21-8), and then executes a step S21-9. On the other hand, if determining in the step S21-5 that the user has not selected replacement items to be displayed on the screen showing the menu of maintenance items (FIG. 17B), the CPU 461 executes the step S21-2 again.

The CPU 461 determines in the step S21-9 whether "RETURN" has been selected or not. If determining in the step S21-9 that the user has selected "RETURN", the CPU 461 executes the step S21-1. If determining in the step S21-9 that the user has not selected "RETURN", the CPU 461 determines whether the user has selected a maintenance-execution/setting-input screen to be displayed (step S21-10).

If determining in the step S21-10 that the user has selected the maintenance-execution/setting-input screen to be displayed, the CPU 461 displays the maintenance-execution/setting-input screen (FIG. 17D) selected by the user in the step S21-10 (step S21-11), and then executes a step S21-12. On the other hand, if determining in the step S21-10 that the user has not selected a maintenance-execution/setting-input screen to be displayed, the CPU 461 executes the step S21-9 again.

If determining in the step S21-12 that the user has selected "RETURN" on the maintenance-execution/setting-input screen (FIG. 17D), the process returns to the step S21-1. If determining in the step S21-12 that the user has selected "RETURN", the CPU 461 determines whether the user has selected "OK", i.e. whether the user has selected the execution of maintenance and the execution of input settings (step S21-13).

If determining in the step S21-13 that the user has selected "OK", the CPU 461 executes maintenance and inputs settings as selected by the user in the step S21-10 (step S21-14), and executes the step S21-1. On the other hand, if determining in the step S21-13 that the user has selected "OK", the CPU 461 executes the step S21-12 again.

Figure 21:
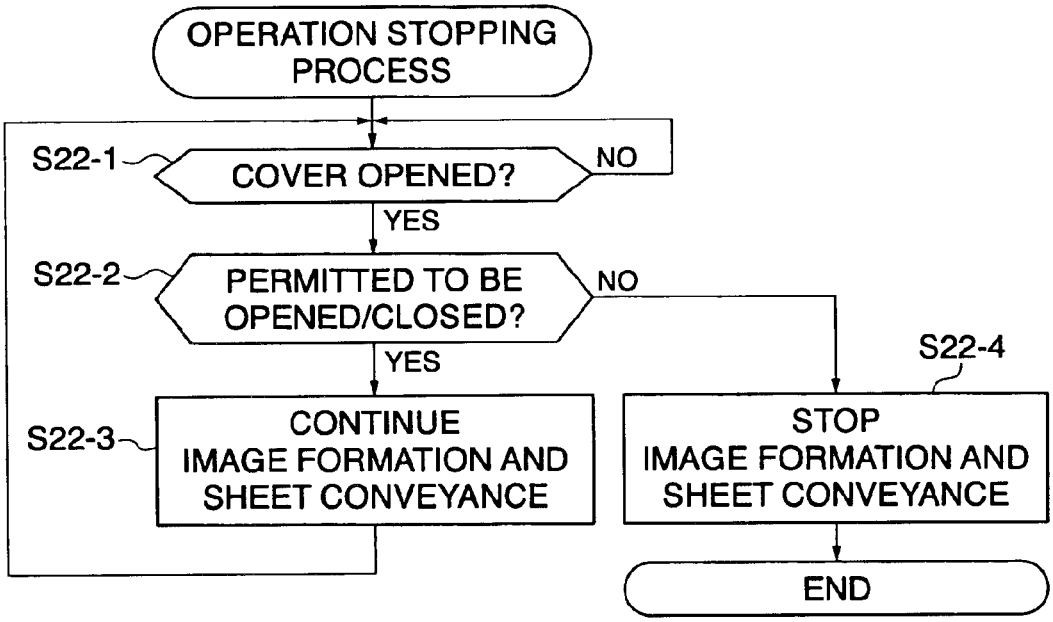
FIG. 21 is a flow chart showing the procedure of an operation stopping process executed by an image forming apparatus according to the first embodiment.

FIG. 21 is a flow chart showing a operation stopping process executed by the image forming apparatus according to the first embodiment. According to the first embodiment, when the user opens a cover which is not permitted to be opened and closed, image formation and sheet conveyance are stopped. This control process is carried out by the CPU circuit block 150, but may be carried out by the CPU circuit block 561, 661, or 761 provided in the sheet processing apparatus.

First, the opening of any of the covers 352, 353, 551, 552, 651, 652, 751, 752, and 753 is awaited (step S22-1). The opening of each cover is detected by a cover opening/closing detecting sensor corresponding to the cover. If it is determined in the step S22-1 that any cover has been opened, it is determined whether the cover is permitted to be opened and closed (step S22-2).

In the step S22-2, the information is read out from the ROM 151, which stores the above described information appearing in FIG. 18, to determine whether the opened cover is permitted to be opened and closed according to settings as to various processes.

If it is determined in the step S22-2 that the opened cover is not permitted to be opened and closed, image formation and sheet conveyance are continued (step S22-3), and the process returns to the step S22-1. If it is determined in the step S22-2 that the opened cover is permitted to be opened and closed, image formation and sheet conveyance are stopped (step S22-4), followed by the process being terminated.

Figure 22:
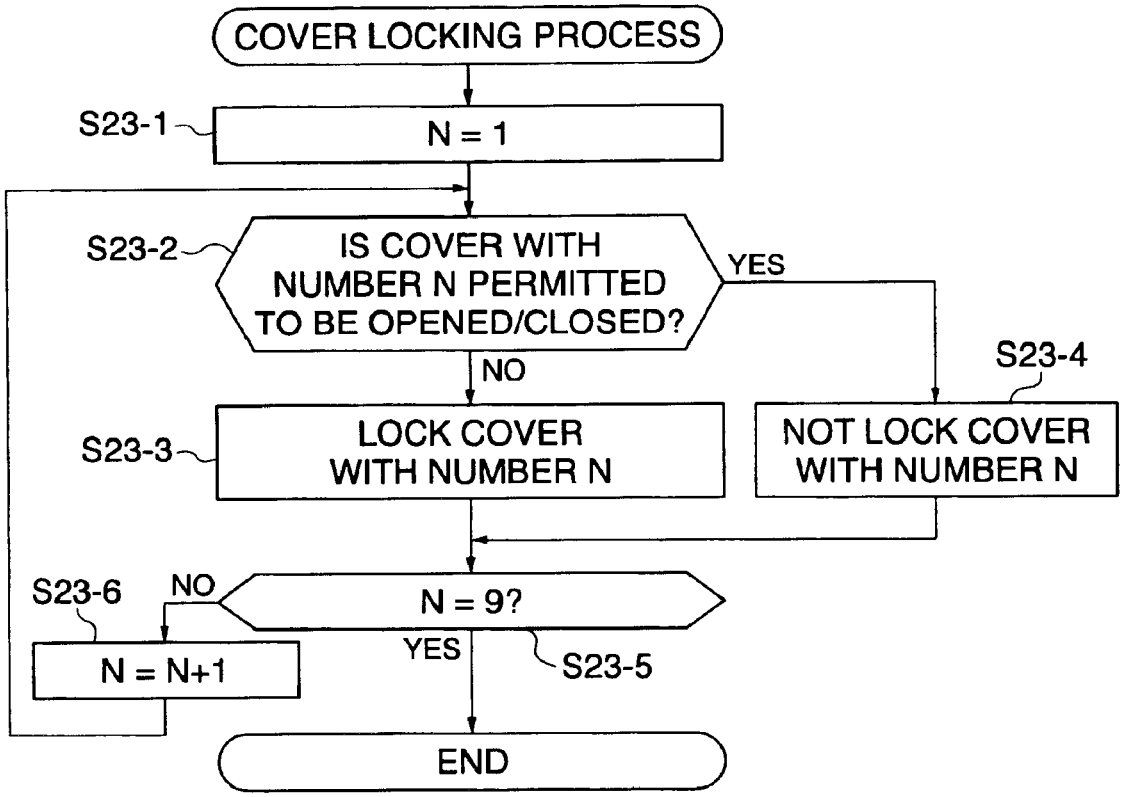
FIG. 22 is a flow chart showing the procedure of a cover locking process executed by an image forming apparatus according to a second embodiment of the present invention.
Figure 23A:
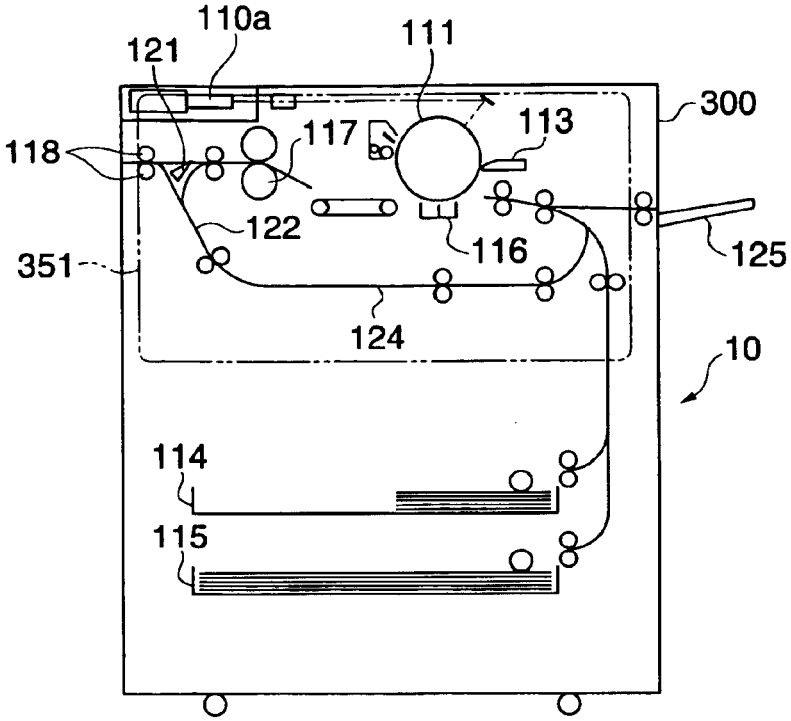
Figure 23B:
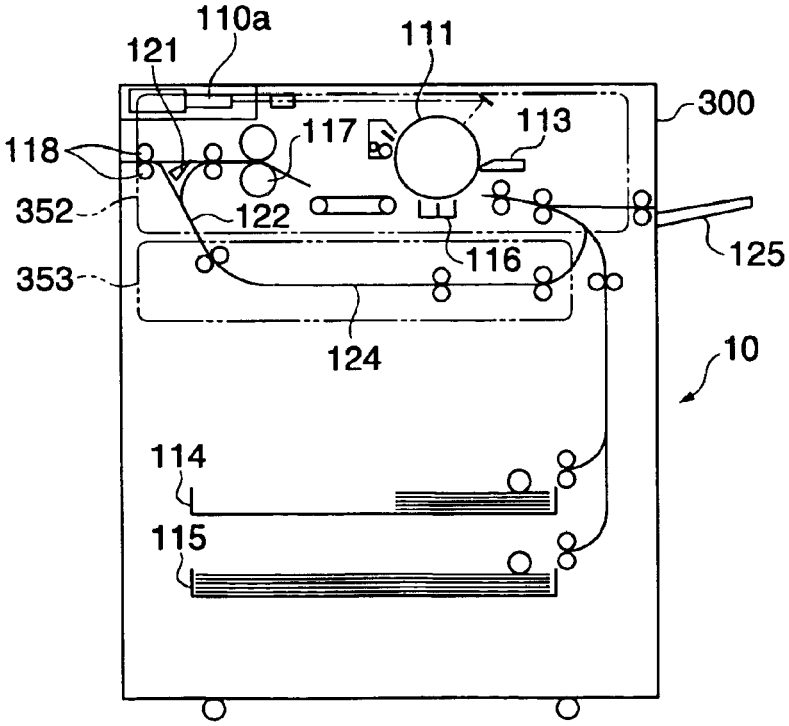

FIG. 22 is a flow chart showing a cover locking process executed by an image forming apparatus according to a second embodiment of the present invention. According to the second embodiment, even if the user tries to open a cover which is not permitted to be opened and closed, the above described cover locking mechanism is caused to lock the cover so that the cover cannot be opened. The control process according to the present embodiment is carried out by the CPU circuit block 150 as is the case with the first embodiment, but may be carried out by the CPU circuit block 561, 661, or 761 provided in the sheet processing apparatus. In the present embodiment, it is assumed that numbers 1 to 9 are assigned in advance to nine covers consisting of the covers 352, 353, 551, 552, 651, 652, 751, 752, and 753.

First, in a step S23-1, "1" is assigned to a variable N. This means that the covers are sequentially checked starting with the cover to which the number "1" is assigned. Then, it is determined whether or not the cover to which the number N is assigned is permitted to be opened and closed (step S23-2).

In the step S23-2, the information is read out from the ROM 151, which stores the above described information appearing in FIG. 18, to determine whether the cover is permitted to be opened and closed according to settings as to various processes.

If it is determined in the step S23-2 that the cover to which the number N is assigned is not permitted to be opened and closed, the above described cover locking mechanism is caused to lock the cover (step S23-3), and the process then proceeds to a step S23-5. If it is determined in the step S23-2 that the cover to which the number N is assigned is permitted to be opened and closed, the cover is not locked, but the process proceeds to the step S23-5.

In the step S23-5, whether covers are to be locked or not is determined with respect to all the covers. Specifically, whether the variable N is equal to 9 or not is determined in the step S23-5. If the variable N is equal to 9, the process is terminated, and if not, the process proceeds to a step S23-6.

In the step S23-6, "1" is added to the variable N so as to determine whether the cover to which the next number is assigned is to be locked or not, and the process then returns to the step S23-2.

What is claimed is:

1. An image forming apparatus connected to a sheet processing apparatus having a plurality of covers capable of being opened and closed, comprising:

an operating section that makes settings as to post-processing to be performed on sheets by the sheet processing apparatus;

a determining section responsive to opening of any of the plurality of covers, for making a determination as to whether image formation and sheet conveyance are to be stopped or continued, according to the settings made by said operating section; and a controller that provides control according to a result of the determination made by said determining section.

2. An image forming apparatus according to claim 1, comprising:

a storage that stores information indicative of whether image formation and sheet conveyance are to be stopped or continued when each of the plurality of covers is opened according to patterns of the settings as to post-processing; and wherein said determining section makes the determination according to the information stored in said storage.

3. An image forming apparatus according to claim 1, comprising:

light emitters operable in accordance with the settings made by said operating section, for emitting light to indicate which covers do not cause image formation and sheet conveyance to be stopped even when opened among the plurality of covers.

4. An image forming apparatus according to claim 3, wherein said light emitters are provided in association with respective ones of the plurality of covers.

5. An image forming apparatus according to claim 1, comprising:

a display that displays information indicative of the settings made by said operating section; and wherein said display displays information indicative of which covers do not cause image formation and sheet conveyance to be stopped when opened among the plurality of covers according to the settings made by said operating section.

6. An image forming apparatus according to claim 1, wherein said determining section is operable in accordance with the settings made by said operating section, for determining that image formation and sheet conveyance are to be continued even when all the covers provided in the sheet processing apparatus are opened while the sheet processing apparatus is not to be used.

7. An image forming apparatus connected to a sheet processing apparatus having a plurality of covers capable of being opened and closed, comprising:

a locking section that locks each of the plurality of covers to inhibit the cover from being opened;

an operating section that makes settings as to post-processing to be performed on a sheet on which an image has been formed by the image forming apparatus;

a determining section that makes a determination as to whether each of the plurality of covers is to be locked by said locking section, according to the settings made by said operating section; and a controller that provides control according to a result of the determination made by said determining section.

8. A sheet processing apparatus connected to an image forming apparatus which forms an image on a sheet, for performing post-processing on a sheet on which an image has been formed by the image forming apparatus, conveyed to the sheet processing apparatus, comprising:

a plurality of covers capable of being opened and closed;

a determining section responsive to opening of any of said plurality of covers, for making a determination as to whether image formation and sheet conveyance are to be stopped or continued, according to settings as to post-processing; and a controller that provides control according to a result of the determination made by said determining section.

9. A sheet processing apparatus connected to an image forming apparatus which forms an image on a sheet, for performing post-processing on a sheet on which an image has been formed by the image forming apparatus, conveyed to the sheet processing apparatus, comprising:

a plurality of covers capable of being opened and closed;

a locking section that locks each of said plurality of covers to inhibit the cover from being opened;

a determining section that makes a determination as to whether each of said plurality of covers is to be locked by said locking section, according to settings as to post-processing; and a controller that provides control according to a result of the determination made by said determining section.

10. An image forming system including an image forming apparatus which forms an image on a sheet, and a sheet processing apparatus which performs post-processing on a sheet on which an image has been formed by said image forming apparatus, conveyed to said sheet processing apparatus, said sheet processing apparatus having a plurality of covers capable of being opened and closed, comprising:

an operating section that makes settings as to post-processing to be performed on a sheet on which an image has been formed by said image forming apparatus;

a determining section responsive to opening of any of said plurality of covers, for making a determination as to whether image formation and sheet conveyance are to be stopped or continued, according to the settings made by said operating section; and a controller that provides control according to a result of the determination made by said determining section.

11. An image forming system according to claim 10, comprising:

a common conveying path through which all of sheets conveyed from said image forming apparatus to said sheet processing apparatus pass; and a function module section that performs post-processing on a sheet; and wherein said determining section determines that image formation and sheet conveyance are to be stopped when one of the plurality of covers for covering said common conveying path or said function module section is opened while said common conveying path or said function module section is to be used, and determines that image formation and sheet conveyance are to be continued when the cover for covering said common conveying path or said function module section is opened while said common conveying path or said function module section is not to be used.

12. An image forming system according to claim 11, wherein said function module section is capable of being taken out from said sheet processing apparatus in a state in which the cover for covering said function module part is opened.

13. An image forming system including an image forming apparatus which forms an image on a sheet, and a sheet processing apparatus which performs post-processing on a sheet on which an image has been formed by said image forming apparatus, conveyed to said sheet processing apparatus, said sheet processing apparatus having a plurality of covers capable of being opened and closed, comprising:

a locking section that locks each of said plurality of covers to inhibit the cover from being opened;

an operating section that makes settings as to post-processing to be performed on a sheet on which an image has been formed by the image forming apparatus;

a determining section that makes a determination as to whether each of said plurality of covers is to be locked by said locking section, according to the settings made by said operating section; and a controller that provides control according to a result of the determination made by said determining section.

* * * * *